US010835067B2

(12) United States Patent
Rane et al.

(10) Patent No.: US 10,835,067 B2
(45) Date of Patent: Nov. 17, 2020

(54) BEVERAGE HOLDER

(71) Applicant: YETI Coolers, LLC, Austin, TX (US)

(72) Inventors: Mark Rane, Austin, TX (US); Matthew Joseph Petrillo, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 160 days.

(21) Appl. No.: 15/443,854

(22) Filed: Feb. 27, 2017

(65) Prior Publication Data

US 2018/0242765 A1 Aug. 30, 2018

(51) Int. Cl.
*A47G 23/02* (2006.01)
*B65D 81/38* (2006.01)

(52) U.S. Cl.
CPC ..... *A47G 23/0241* (2013.01); *A47G 23/0266* (2013.01); *B65D 81/3881* (2013.01); *A47G 2023/0275* (2013.01)

(58) Field of Classification Search
CPC ..... A47G 23/0241; A47G 23/0266; A47G 2023/0275; B65D 81/3881
USPC ..... 206/592.16
See application file for complete search history.

(56) References Cited

U.S. PATENT DOCUMENTS

| | | | |
|---|---|---|---|
| 1,191,319 | A | 7/1916 | Kline |
| D105,373 | S | 7/1937 | Connor |
| 2,215,691 | A | 9/1940 | East |
| 2,414,697 | A | 1/1947 | Pettersson |
| 2,484,608 | A | 10/1949 | Cheyney |
| 2,675,954 | A | 4/1954 | Vogel |
| 3,128,029 | A | 4/1964 | Price |
| 3,353,729 | A | 11/1967 | Hull |
| 3,421,681 | A | 1/1969 | Frank |
| 3,463,140 | A | 8/1969 | Rollor, Jr. |
| 3,571,940 | A | 3/1971 | Bender |
| 3,578,524 | A | 5/1971 | Ignell |
| 3,730,383 | A | 5/1973 | Dunn et al. |
| D227,532 | S | 7/1973 | Refsgaard |
| 3,753,512 | A | 8/1973 | Curry |
| D231,068 | S | 4/1974 | Douglas |
| 3,827,925 | A | 8/1974 | Douglas |
| 3,995,445 | A | 12/1976 | Huskins |
| 4,027,779 | A | 6/1977 | De Long |

(Continued)

FOREIGN PATENT DOCUMENTS

| | | |
|---|---|---|
| CN | 3606899 | 2/2007 |
| CN | 3681232 | 8/2007 |

(Continued)

OTHER PUBLICATIONS

YETI Rambler Colster Beverage Holder [online] [retrieved Feb. 1, 2018] Retrieved from the Internet, URL: <https://kevinscatalog.com/yeti-colster-beverage-holder-44-1064>.

(Continued)

*Primary Examiner* — Anthony D Stashick
*Assistant Examiner* — James M Van Buskirk
(74) *Attorney, Agent, or Firm* — Banner & Witcoff, Ltd.

(57) ABSTRACT

A beverage holder is provided. The beverage holder may include a container having a first outer wall and a second inner wall and a sealed vacuum cavity formed between the first outer wall and second inner wall. The beverage holder may also include a fastening seal having an engagement portion configured to removably engage the container and a retention portion configured to engage a beverage container.

22 Claims, 7 Drawing Sheets

(56) References Cited

U.S. PATENT DOCUMENTS

D246,029 S 10/1977 Lynn et al.
4,055,273 A 10/1977 Jones
D247,541 S 3/1978 Barger
4,136,799 A 1/1979 Albert
D250,986 S 2/1979 Thrush
4,151,923 A 5/1979 Bernardi et al.
4,163,374 A 8/1979 Moore et al.
4,183,226 A 1/1980 Moore
D257,524 S 11/1980 Heinrich
D258,795 S 4/1981 Zamorski
4,261,501 A 4/1981 Watkins et al.
D263,581 S 3/1982 Kaye
4,344,303 A 8/1982 Kelly, Jr.
D266,391 S 10/1982 Jordon
D269,147 S 5/1983 Trombly
4,452,374 A 6/1984 Hitchcock et al.
4,452,375 A 6/1984 Marcus
D274,502 S 7/1984 Little
D277,921 S 3/1985 Otto
4,540,611 A 9/1985 Henderson
D285,637 S 9/1986 Zieff et al.
D286,604 S 11/1986 Bierlein et al.
4,620,642 A 11/1986 Wertz et al.
D286,967 S 12/1986 Appel
D288,766 S 3/1987 Tardif
D289,143 S 4/1987 Guillaume
4,715,633 A 12/1987 Brink et al.
4,720,023 A 1/1988 Jeff
4,746,028 A 5/1988 Bagg
4,798,063 A 1/1989 Rimmer
D299,688 S 2/1989 Chung
D300,495 S 4/1989 Minuti
D301,821 S 6/1989 Bartolo
D307,089 S 4/1990 Lage
D309,545 S 7/1990 Ancona et al.
4,953,743 A 9/1990 Dart et al.
D312,044 S 11/1990 Davis
5,029,720 A 7/1991 Bridges
D319,755 S 9/1991 Guy
D322,753 S 12/1991 Sussman
D324,281 S 2/1992 Brussing
D324,976 S 3/1992 Katz
D327,093 S 6/1992 Evenson
5,168,140 A 12/1992 Welker
D334,869 S 4/1993 Mills
5,249,703 A 10/1993 Karp
D345,676 S 4/1994 Biffle
D346,092 S 4/1994 Van De Velde
D351,314 S 10/1994 Sokolski et al.
D352,201 S 11/1994 Spence, Jr.
D352,210 S 11/1994 Cousins et al.
5,398,842 A 3/1995 Sokolski et al.
5,400,907 A 3/1995 Chen
D358,531 S 5/1995 Cousins et al.
D360,133 S 7/1995 Boller
5,433,339 A 7/1995 Sarver
D363,642 S 10/1995 Goto et al.
5,467,891 A 11/1995 Perry
D366,186 S 1/1996 Kato
D368,830 S 4/1996 Lu
5,508,498 A 4/1996 Rheinish et al.
D370,300 S 5/1996 Gottvald et al.
5,531,353 A 7/1996 Ward et al.
D373,290 S 9/1996 Bailin
D375,870 S 11/1996 Stonehouse
5,573,141 A 11/1996 Chen
D377,741 S 2/1997 Bennett et al.
D379,740 S 6/1997 Miller
D384,246 S 9/1997 McKnight
D386,948 S 12/1997 Wissinger
D395,200 S 6/1998 Bidwell
5,769,262 A 6/1998 Yamada et al.
D396,605 S 8/1998 Benson
D399,099 S 10/1998 Cousins
5,820,016 A 10/1998 Stropkay
5,839,599 A 11/1998 Lin
D401,808 S 12/1998 Grivsky
D404,241 S 1/1999 Bagley
D404,974 S 2/1999 Kristinik
D405,609 S 2/1999 Fu et al.
D408,689 S 4/1999 Kato
D409,445 S 5/1999 Lage et al.
5,948,728 A 9/1999 Patton et al.
D415,651 S 10/1999 Trombly
5,964,102 A 10/1999 Tsai
D416,444 S 11/1999 Jørgensen
D417,590 S 12/1999 Kato
D418,013 S 12/1999 Fujii
6,050,443 A 4/2000 Tung
6,065,609 A 5/2000 Lake
6,065,632 A 5/2000 Moore, Jr.
D427,853 S 7/2000 Kohlhase
6,085,931 A 7/2000 Sadow
D433,599 S 11/2000 Kristiansen et al.
6,161,720 A 12/2000 Castle
D436,804 S 1/2001 Wolfe
D441,288 S 5/2001 Pillers et al.
D442,833 S 5/2001 Shuman
D445,687 S 7/2001 Gilbertson
D447,005 S 8/2001 Trombly
6,352,168 B1 3/2002 Lin
D455,047 S 4/2002 Wolfe et al.
D455,048 S 4/2002 Marck
D455,052 S 4/2002 Gullickson et al.
D455,610 S 4/2002 Bridges
D455,612 S 4/2002 Gullickson et al.
D455,933 S 4/2002 Marck
6,371,328 B1 4/2002 Yamada et al.
D457,036 S 5/2002 Manuel
6,392,206 B1 5/2002 Von Arx et al.
6,398,065 B1 6/2002 Lewis
6,409,038 B1 6/2002 Karp
D465,132 S 11/2002 Janky et al.
D466,814 S 12/2002 Hurlburt
D470,724 S 2/2003 Basara
D471,064 S 3/2003 Renz
D472,145 S 3/2003 Nottingham et al.
D473,105 S 4/2003 Ayers et al.
D474,651 S 5/2003 Ward
D476,528 S 7/2003 Janky et al.
6,626,326 B2 9/2003 Murakami
D483,610 S 12/2003 Kerman
6,685,047 B1 2/2004 Mott et al.
D489,574 S 5/2004 Copeland
D493,332 S 7/2004 Bin
D497,079 S 10/2004 Paggio
D497,778 S 11/2004 Rich
D502,050 S 2/2005 Munson et al.
D502,052 S 2/2005 Meade
D507,155 S 7/2005 Gosen et al.
D521,802 S 5/2006 Sands
D527,222 S 8/2006 Liu
D530,852 S 10/2006 Zheng
D540,124 S 4/2007 Ross
7,201,285 B2 4/2007 Beggins
D547,611 S 7/2007 Seum et al.
D549,523 S 8/2007 Montes
D552,932 S 10/2007 Carlson
D553,910 S 10/2007 Bodum
D556,509 S 12/2007 Bonini
D557,564 S 12/2007 Bodum
D562,072 S 2/2008 Wahl
D564,356 S 3/2008 Nickleberry
D565,900 S 4/2008 Franco
D567,590 S 4/2008 Bodum
H2217 H 6/2008 Smay et al.
D570,213 S 6/2008 Newman
D572,136 S 7/2008 Boni
D573,390 S 7/2008 Ablo
D585,245 S 1/2009 Brouillette
D586,182 S 2/2009 Trombly
D587,967 S 3/2009 Wahl
D588,497 S 3/2009 Claffey
D592,056 S 5/2009 Tedford, Jr.

(56) References Cited

U.S. PATENT DOCUMENTS

| | | | |
|---|---|---|---|
| D593,372 | S | 6/2009 | Carreno |
| D593,811 | S | 6/2009 | Carreno |
| D594,687 | S | 6/2009 | Bodum |
| D600,073 | S | 9/2009 | Carreno |
| D600,978 | S | 9/2009 | Poindexter et al. |
| D608,133 | S | 1/2010 | Choi |
| D610,006 | S | 2/2010 | Ortell |
| D615,817 | S | 5/2010 | George |
| D616,248 | S | 5/2010 | George |
| D617,608 | S | 6/2010 | Yang et al. |
| D621,667 | S | 8/2010 | Ablo |
| D622,554 | S | 8/2010 | Carreno |
| D626,414 | S | 11/2010 | Cresswell et al. |
| D627,192 | S | 11/2010 | Gilbert et al. |
| D629,657 | S | 12/2010 | Carreno |
| D629,691 | S | 12/2010 | Cresswell et al. |
| D635,400 | S | 4/2011 | Snyder |
| D635,401 | S | 4/2011 | DelVecchio |
| D639,608 | S | 6/2011 | Tohm, Sr. |
| D641,591 | S | 7/2011 | Tsukida |
| D649,836 | S | 12/2011 | Dooley et al. |
| D650,232 | S | 12/2011 | Gilbert |
| D653,082 | S | 1/2012 | George |
| D655,134 | S | 3/2012 | Gilbert |
| D656,361 | S | 3/2012 | Gilbert |
| D657,670 | S | 4/2012 | Folos et al. |
| D660,084 | S | 5/2012 | Gilbert |
| D660,655 | S | 5/2012 | Wahl et al. |
| D663,169 | S | 7/2012 | Beggins et al. |
| 8,225,957 | B1 | 7/2012 | Volan |
| D666,061 | S | 8/2012 | Ying |
| 8,251,247 | B1 | 8/2012 | Breckner |
| D675,066 | S | 1/2013 | Conlin et al. |
| D675,100 | S | 1/2013 | Herbst |
| D676,746 | S | 2/2013 | Shaffer et al. |
| D679,949 | S | 4/2013 | Meritt |
| D679,960 | S | 4/2013 | Hopkins et al. |
| D680,375 | S | 4/2013 | Pousard et al. |
| D680,378 | S | 4/2013 | Romley |
| D680,387 | S | 4/2013 | Hopkins et al. |
| D682,625 | S | 5/2013 | Lane |
| D682,626 | S | 5/2013 | Lane |
| D684,459 | S | 6/2013 | Stowe et al. |
| D684,819 | S | 6/2013 | Smith |
| D685,231 | S | 7/2013 | Lane |
| D691,847 | S | 10/2013 | Beckman |
| D694,112 | S | 11/2013 | Brown |
| D695,138 | S | 12/2013 | Ball |
| D699,595 | S | 2/2014 | Farrow et al. |
| D710,155 | S | 8/2014 | Tatsukawa |
| D710,698 | S | 8/2014 | Giraud et al. |
| D711,684 | S | 8/2014 | Perdomo |
| D715,100 | S | 10/2014 | Eyal |
| D715,101 | S | 10/2014 | Grcic |
| D719,785 | S | 12/2014 | Grcic |
| D719,788 | S | 12/2014 | Soltz et al. |
| D720,187 | S | 12/2014 | Romley |
| D721,250 | S | 1/2015 | Chen et al. |
| D721,546 | S | 1/2015 | Davidson |
| D722,830 | S | 2/2015 | Miller |
| D724,385 | S | 3/2015 | Hurley et al. |
| D727,688 | S | 4/2015 | Hewitt et al. |
| D728,314 | S | 5/2015 | Carstensen et al. |
| D730,696 | S | 6/2015 | Nemeth et al. |
| D731,240 | S | 6/2015 | Bell et al. |
| D731,241 | S | 6/2015 | Yessin et al. |
| D732,347 | S | 6/2015 | Katterheinrich et al. |
| D742,743 | S | 11/2015 | Thurin et al. |
| D743,207 | S | 11/2015 | Pendleton et al. |
| D747,626 | S | 1/2016 | Morris, II et al. |
| D747,929 | S | 1/2016 | Arseneau et al. |
| D751,341 | S | 3/2016 | Seiders et al. |
| D752,397 | S | 3/2016 | Seiders et al. |
| D759,483 | S | 6/2016 | Jalet |
| D764,870 | S | 8/2016 | Choi |
| D766,661 | S | 9/2016 | Bodum |
| D772,012 | S | 11/2016 | Wampold |
| D773,250 | S | 12/2016 | Miller |
| D776,980 | S | 1/2017 | Thun et al. |
| D779,285 | S | 2/2017 | Seiders et al. |
| D779,891 | S | 2/2017 | Seiders et al. |
| D779,892 | S | 2/2017 | Seiders et al. |
| D780,530 | S | 3/2017 | Seiders et al. |
| D780,531 | S | 3/2017 | Seiders et al. |
| D780,532 | S | 3/2017 | Seiders et al. |
| D780,533 | S | 3/2017 | Seiders et al. |
| D782,878 | S | 4/2017 | Thun et al. |
| D784,137 | S | 4/2017 | Cates |
| D786,025 | S | 5/2017 | Seiders et al. |
| D786,673 | S | 5/2017 | Moffat |
| D790,272 | S | 6/2017 | Han |
| D791,543 | S | 7/2017 | Mulhauser et al. |
| D795,007 | S | 8/2017 | Plassmeyer |
| D795,643 | S | 8/2017 | Barlow |
| D797,510 | S | 9/2017 | Ke |
| D798,112 | S | 9/2017 | Godsey |
| 9,750,359 | B2 | 9/2017 | Kah, Jr. |
| D803,001 | S | 11/2017 | Bodum |
| D813,607 | S | 3/2018 | Nally et al. |
| D814,243 | S | 4/2018 | Pape |
| D820,046 | S | 6/2018 | Seiders et al. |
| D822,440 | S | 7/2018 | Kuh et al. |
| D827,381 | S | 9/2018 | Boroski |
| D830,788 | S | 10/2018 | Petrillo et al. |
| D832,050 | S | 10/2018 | Diener et al. |
| D839,676 | S | 2/2019 | Seiders et al. |
| D839,677 | S | 2/2019 | Seiders et al. |
| 2003/0159245 | A1 | 8/2003 | Harman |
| 2004/0080930 | A1 | 4/2004 | Winters et al. |
| 2004/0149763 | A1 | 8/2004 | Chen |
| 2007/0114236 | A1 | 5/2007 | Shifter et al. |
| 2008/0237242 | A1 | 10/2008 | Gifford |
| 2015/0122828 | A1 | 5/2015 | Madala |
| 2017/0267408 | A1 | 9/2017 | Martinez |
| 2018/0312322 | A1 | 11/2018 | Canales Kell |

FOREIGN PATENT DOCUMENTS

| | | |
|---|---|---|
| CN | 300754212 | 3/2008 |
| CN | 300959563 | 7/2009 |
| CN | 300959564 | 7/2009 |
| CN | 300959565 | 7/2009 |
| CN | 301026132 | 9/2009 |
| CN | 301095376 | 12/2009 |
| CN | 202104668 U | 1/2012 |
| CN | 202891397 U | 4/2013 |
| CN | 302846604 | 6/2014 |
| CN | 302892949 | 7/2014 |
| CN | 303123979 | 3/2015 |
| CN | 303263048 | 7/2015 |
| CN | 303517025 | 12/2015 |
| CN | 304215274 | 7/2017 |
| CN | 304296007 | 9/2017 |
| CN | 304405160 | 12/2017 |
| CN | 304435767 | 1/2018 |
| CN | 304453288 | 1/2018 |
| CN | 304512433 | 2/2018 |
| CN | 304563902 | 4/2018 |
| CN | 304655117 | 6/2018 |
| CN | 304721141 | 7/2018 |
| CN | 304745435 | 7/2018 |
| CN | 304786699 | 8/2018 |
| EM | 000564778-0001 | 8/2006 |
| EM | 001360911-0001 | 3/2013 |
| EM | 002939926-0001 | 1/2016 |
| EM | 004742526-0001 | 4/2018 |
| EM | 005322914-0001 | 7/2018 |
| EM | 005322914-0002 | 7/2018 |
| GB | 3024951 | 7/2006 |
| GB | 5000865 | 4/2016 |
| IN | 250749-0001 | 8/2013 |
| IN | 263049-0001 | 3/2015 |
| JP | 1219538 | 10/2004 |
| JP | 1288694 | 12/2006 |

(56) References Cited

FOREIGN PATENT DOCUMENTS

| | | |
|---|---|---|
| JP | 1302290 | 6/2007 |
| JP | 1370441 | 10/2009 |
| JP | 1483261 | 11/2013 |
| JP | D1483261 | 11/2013 |
| JP | D1483263 | 11/2013 |
| JP | 1546179 S | 3/2016 |
| JP | D1546179 | 3/2016 |
| KR | 300840850 | 2/2016 |
| KR | 300840850.0000 | 2/2016 |
| KR | 300905323.0000 | 5/2017 |
| KR | 3009075550001 | 5/2017 |
| KR | 300924542.0000 | 9/2017 |
| KR | 300933350.0000 | 11/2017 |
| PH | 3-2012-31-0001 | 5/2012 |
| WO | D094255-001 | 1/2017 |

OTHER PUBLICATIONS

United States District Court Western District of Texas Austin Division, "Complaint," *YETI Coolers, LLC* v. *Wal-Mart Stores, Inc.*, Case: 1:17-cv-01145, Document #1, filed Dec. 8, 2017, 98 pages.

United States International Trade Commission, "Respondents Alibaba, Dunhuang Group, and Bonanza.com's Notice of Prior Art," In the Matter of: Certain Insulated Beverage Containers, Components, Labels, and Packaging Materials Thereof, Inv. No. 337-TA-1084, filed Feb. 9, 2018, 8 pages.

United States International Trade Commission, "Respondent Contextlogic, Inc.'s Notice of Prior Art," In the Matter of: Certain Insulated Beverage Containers, Components, Labels, and Packaging Materials Thereof, Inv. No. 337-TA-1084, filed Feb. 9, 2018, 15 pages.

United States International Trade Commission, "The Commission Investigative Staffs Notice of Prior Art" In the Matter of: Certain Insulated Beverage Containers, Components, Labels, and Packaging Materials Thereof, Inv. No. 337-TA-1084, filed Feb. 9, 2018, 4 pages.

Thermos Funtainer 10 oz Food Jar [online], [retrieved Aug. 6, 2018], Retrieved from the Internet, URL: <https://www.amazon.com/Thermos-Funtainer-Ounce-Food-Blue/dp/B00CBFAE6W?ref=ast_p_pc>; 10 color pages, published date unknown, but for purposes of patent prosecution prior to the filing date of the present application.

Thermos Funtainer 16 oz Food Jar [online], [retrieved Aug. 6, 2018], Retrieved from the Internet: URL: <<https://www.amazon.com/Thermos-Funtainer-Ounce-Food-Charcoal/dp/B01ATVK4KK?ref=ast_p_pc_rc&th-1>>; 7 color pages, published date unknown, but for purposes of patent prosecution prior to the filing date of the present application.

United States District Court Western District of Texas Austin Division, "Defendant Kelly Scoggins d/b/a King Engraving's Memorandum in Support of Rule 12(b)(6) Motion to Dismiss and Motion to Take Judicial Notice," *YETI coolers, LLC* v. *JDS Industries, Inc., Lionel Landry Jr., d/b/a Accolades d/b/a Accolades Awards & Engraving, Creative and Fast LLC d/b/a Promotional Products San Antonio, Kelly Scoggins d/b/a King Engraving*, Case: 1:17-cv-00424-RP, Document #65, filed Aug. 11, 2017, 28 pages.

United States District Court Western District of Texas Austin Division, "Defendant Kelly Scoggins d/b/a King Engraving's Reply in Support of Rule 12(b)(6) Motion to Dismiss," *YETI Coolers, LLC* v. *JDS Industries, Inc., Lionel Landry Jr., d/b/a Accolades d/b/a Accolades Awards & Engraving, Creative and Fast LLC d/b/a Promotional Products San Antonio, Kelly Scoggins d/b/a King Engraving*, Case: 1:17-cv-00424-RP, Document #75, filed Sep. 1, 2017, 26 pages.

Firm Grip: The 15 Coolest Beer Koozies [online], [retrieved Mar. 16, 2018], Retrieved from the Internet, URL: <<http://hiconsumption.com/2014/01/firm-grip-the-15-coolest-beer-koozies/>>, 10 color pages, published date unknown, but for purposes of patent prosecution prior to the filed of the present application.

Thermos Stainless Steel Can Insulator [online], [retrieved Mar. 19, 2018], Retrieved from the Internet, URL: <<https://www.youtube.com/watch?v=p8pV3BhAOiU>>, 1 color page, published on Oct. 8, 2008.

Custom Ventura Travel Tumbler—Promotional Travel Mugs at 4imprint [online], [retrieved Mar. 19, 2018], Retrieved from the Internet, URL: < <https://www.youtube.com/watch?v=e8okCU8DaP4>>, 1 color page, published on Dec. 19, 2014.

15 Oz. Stainless Steel Double Wall Tumbler [online], [retrieved Mar. 19, 2018], Retrieved from the Internet, URL: <<https://www.4allpromos.com/product/15-oz-stainless-steel-double-wall-tumbler>>, 5 color pages, published date unknown, but for purposes of patent prosecution prior to the filing date of the present application.

Personalized Color Touch Stainless Tumbler—Promotional Travel Mugs by 4imprint [online], [retrieved Mar. 19, 2018], Retrieved from the Internet, URL: <<https://www.youtube.com/watch?v=v7TLpRMCFIw>>, 1 color page, published on Dec. 18, 2014.

15 oz. Stainless Deal Tumbler—Custom Promotional Coffee Tumblers from InkHead.com [online], [retrieved Mar. 19, 2018], Retrieved from the Internet, URL: <<https://www.youtube.com/watch?v=vywesydY6xs>>, 1 color page, published on Jul. 11, 2011.

Reflections Metallic Tumbler [online], [retrieved Mar. 19, 2018], Retrieved from the Internet, URL: <<https://www.youtube.com/watch?v=cNT6h4cKfAs>>, 1 color page, published on Jan. 9, 2014.

Swag Standard | Seaside 15-oz. Travel Mug [online], [retrieved Mar. 19, 2018], Retrieved from the Internet, URL: <https://www.youtube.com/watch?v=cb58zm_PSOo>, 1 color page, published on Mar. 3, 2015.

Logo Coffee Mugs—Stainless Steel Tumbler w/ Color Trim—MARCO [online], [retrieved Mar. 19, 2018], Retrieved from the Internet, URL: < https://www.youtube.com/watch?v=2k72dgsWJy8>, 1 color page, published on Apr. 21, 2014.

Promotional Cups—14 oz. Ventura Double Wall Travel Tumblers—MARCO [online], [retrieved Mar. 19, 2018], Retrieved from the Internet, URL: <<https://www.youtube.com/watch?v=QAkt5III5J4>>, 1 color page, published on May 9, 2014.

SnapSeal™ Byron Travel Mug [online], [retrieved Mar. 19, 2018], Retrieved from the Internet, URL: <<https://www.youtube.com/watch?v=dL1IdCz1LD0>>, 1 color page, published on Feb. 13, 2014.

Review of the Starbucks "Clip and Sip" Travel Coffee Mug [online], [retrieved Mar. 19, 2018], Retrieved from the Internet, URL: <<https://www.youtube.com/watch?v=6DfWKhLe1b4>>, 1 color page, published on Nov. 13, 2014.

Stainless Steel Curvy Tumbler (16 Oz.)—Q11830 [online], [retrieved Mar. 19, 2018], Retrieved from the Internet, URL: <<https://www.youtub.com/watch?v=8UCmHszwMLY>>, 1 color page, published on Jul. 8, 2012.

Best Tumbler Thermos Mug for caffe latte or messy drink: Starbucks Reserve Stainless Steel [online], [retrieved Mar. 19, 2018], Retrieved from the Internet, URL: <<https://www.youtube.com/watch?v=h2IWzV6wVbk>>, 1 color page, published on Oct. 22, 2014.

CamelBak Forge Travel Mugs | Crew Review [online], [retrieved Mar. 19, 2018], Retrieved from the Internet, URL: <<https://www.youtub.com/watch?v=XuR0u3OEndY>>, 1 color page, published on Jul. 23, 2015.

Autoseal® West Loop Stainless Travel Mug with Easy-Clean Lid [online], [retrieved Mar. 19, 2018], Retrieved from the Internet, URL: <<https://www.youtube.com/watch?v=bCIubrvh2zs>>, 1 color page, published on Feb. 6, 2014.

Stainless King Food Jar Youtube.wmv [online], [retrieved Mar. 19, 2018], Retrieved from the Internet, URL: <<https://www.youtube.com/watch?v=RGHArOT_rEs>>, 1 color page, published on Oct. 20, 2010.

Thermos Food Jar Review [online], [retrieved Mar. 19, 2018], Retrieved from the Internet, URL: <<https://www.youtube.com/watch?v=3esAaqKc4po>>, 1 color page, published on Jan. 26, 2013.

Thermos Infant [online], [retrieved Mar. 19, 2018], Retrieved from the Internet, URL: <<https://www.youtube.com/watch?v=vUf2MPVSODM>>, 1 color page, published on May 14, 2013.

(56) References Cited

OTHER PUBLICATIONS

Promo Travel Mugs—16 oz. Double Wall Stainless Steel Tumbler—MARCO [online], [retrieved Mar. 19, 2018], Retrieved from the Internet, URL: <<https://www.youtube.com/watch?v=sanCJS5rtig>>, 1 color page, published on Nov. 21, 2012.
Contigo Autoseal Stainless Steel Vacuum Insulated Tumbler Travel Mug Full Review [online], [retrieved Mar. 19, 2018], Retrieved from the Internet, URL: <<https://www.youtube.com/watch?v=O2aiMQmjIFg>>, 1 color page, published on Sep. 16, 2012.
ChillingTheMost.com Houston Boat Show 2014 [online], [retrieved Mar. 19, 2018], Retrieved from the Internet, URL: <<https://www.youtube.com/watch?v=1vUQ43gVL38>>, 1 color page, published on Aug. 29, 2014.
2012 Tampa Boat Show—Chilling the Most [online], [retrieved Mar. 19, 2018], Retrieved from the Internet, URL: <<https://www.youtube.com/watch?v=IWgIdQcYz48>>, 1 color page, published on Oct. 1, 2012.
Contigo Autoseal Spill-Proof Travel Mug Review and Giveaway [online], [retrieved Mar. 19, 2018], Retrieved from the Internet, URL: <<https://www.makeuseof.com/tag/contigo-autoseal-spill-proof-travel-mug-review-and-giveaway/>>, 6 color pages, published on Dec. 28, 2010.
Klean Kanteen 27oz Stainless Steel Bottle w/ Built NY 27oz Bottle Tote [online], [retrieved Mar. 19, 2018], Retrieved from the Internet, URL: <<https://www.youtube.com/watch?v=R411PhqF6Tc>>, 1 color page, published on Sep. 3, 2009.
Teavana Contour Tumbler vs Thermos Review [online], [retrieved Mar. 20, 2018], Retrieved from the Internet, URL: <<https://www.youtube.com/watch?v=O55uWyKiWRM>>, 1 color page, published on Feb. 11, 2013.
KeepCup—Inside Business [online], [retrieved Mar. 20, 2018], Retrieved from the Internet, URL: <<https://www.youtube.com/watch?v=hJ5xUpC8VXQ>>, 1 color page, published on Feb. 14, 2012.
William & the Ordinary Hero Coffee Tumbler [online], [retrieved Mar. 20, 2018], Retrieved from the Internet, URL: <<https://www.youtube.com/watch?v=CwpT_KePTdk>>, 1 color page, published on Jun. 10, 2011.
Persona Vacuum Tumbler (14 Oz.)—Q49231 [online], [retrieved Mar. 20, 2018], Retrieved from the Internet, URL: <<https://www.youtube.com/watch?v=XUoRO3I-uhA>>, 1 color page, published on Dec. 10, 2012.
Product Review: Klean Kanteen Wide Insulated [online], [retrieved Mar. 20, 2018], Retrieved from the Internet, URL: <<https://www.apartmenttherapy.com/product-review-klean-kanteen-w-105234>>, 4 color pages, published on Jan. 6, 2010.
GSI Fairshare Collaspible Cup [online], [retrieved Mar. 20, 2018], Retrieved from the Internet, URL: <<https://www.youtube.com/watch?v=GqWiv4k8Ddc>>, 1 color page, published on Jan. 14, 2013.
How to Clean the JOEmo Reusable Travel Mug Lid [online], [retrieved Mar. 20, 2018], Retrieved from the Internet, URL: <<https://www.youtube.com/watch?v=O39NGhuQDms>>, 1 color page, published on Sep. 12, 2011.
SFS DM400 Photo Tumbler Printing Video [online], [retrieved Mar. 22, 2018], Retrieved from the Internet, URL: <<https://www.youtube.com/watch?v=d9Xyb9StdRY>>, 1 color page, published on Jul. 1, 2012.
Starbucks Stainless Steel Travel Press—Rose Gold 10 fl oz (011028166) Best Buy Deals | Bestseller [online], [retrieved Mar. 22, 2018], Retrieved from the Internet, URL: <<https://www.youtube.com/watch?v=-dhoL4ohTOU>>, 1 color page, published on Oct. 15, 2014.
Custom Full-Wrap Travel Tumbler—Promotional Tumblers by 4imprint [online], [retrieved Mar. 22, 2018], Retrieved from the Internet, URL: <<https://www.youtube.com/watch?v=A8sveo1261s>>, 1 color page, published on Nov. 12, 2014.
15 oz Maui Fusion Tumbler—Custom Travel Coffee Tumblers from InkHead.com [online], [retrieved Mar. 22, 2018], Retrieved from the Internet, URL: <<https://www.youtube.com/watch?v=MrQAJR6skr8>>, 1 color page, published on Apr. 12, 2013.
Thermos Vacuum Insulated 14 oz Travel Tumbler with Lever45;Operated Lid [online], [retrieved Apr. 4, 2018], Retrieved from the Internet, URL: <https://www.amazon.com/Thermos-Insulated-Stainless-Operated-Tumbler/dp/B00JM0KAZO/ref=sr_1_fkmr0_1?ie=UTF8&qid=1522868078&sr=8-1-fkmr0&keywords=thermos+vacuum+insulated+14+oz+travel+tumbler+with+lever+45%3B+operated+lid >, 8 color pages, published date unknown, but for purposes of patent prosecution prior to the filing date of the present application.
United States District Court Western District of Texas Austin Division, "YETI Coolers, LLC's Answer to SIC Products, LLC Counterclaims," *YETI Coolers, LLC* v. *Sic Products LLC, d/b/a Sic Cups, d/b/a Sic*, Case: 1:16-cv-00117-RP, Document #21, Sep. 29, 2016, 15 pages.
United States District Court Western District of Texas Austin Division, "YETI Coolers, LLC's Answer to SIC Products, LLC Counterclaims to YETI Coolers, LLC's Amended Complaint," *YETI Coolers, LLC* v. *Sic Products LLC, d/b/a Sic Cups, d/b/a Sic*, Case: 1:16-cv-00117-RP, Document #38, Dec. 19, 2016, 20 pages.
United States District Court Western District of Texas Austin Division, "Complaint," *YETI Coolers, LLC* v. *The Allen Company, d/b/a Allen Color Craft*, Case: 1:15-cv-00888-RP, Document #1, Oct. 6, 2015, 24 pages.
United States District Court Western District of Texas Austin Division, "Complaint," *YETI Coolers, LLC* v. *Titan Custom Products, Inc.*, Case: 1:15-cv-00775, Document #1, Sep. 2, 2015, 22 pages.
United States District Court Western District of Texas Austin Division, "Answer," *YETI Coolers, LLC* v. *Tree Leaf Marketing, LLC d/b/a Big Frig*, Case: 1:16-cv-00699-RP, Document #11, Oct. 21, 2016, 8 pages.
United States District Court Western District of Texas Austin Division, "Complaint," *YETI Coolers, LLC* v. *Tree Leaf Marketing, LLC d/b/a Big Frig*, Case: 1:16-cv-00699, Document #1, Jun. 17, 2016, 33 pages.
United States District Court Western District of Texas Austin Division, "Complaint," *YETI Coolers, LLC* v. *US Imprints, LLC, d/b/a GOimprints*, Case: 1:15-cv-00773, Document #1, Sep. 2, 2015, 22 pages.
United States District Court Western District of Texas Austin Division, "Order," *YETI Coolers, LLC* v. *US Imprints, LLC, d/b/a GOimprints*, Case: 1:15-cv-00773-RP, Document #23, Apr. 25, 2016, 1 page.
United States District Court Western District of Texas Austin Division, "Veterinary Internet Company, LLC d/b/a VetInternetCo's Answer to Plaintiff's Complaint," *YETI Coolers, LLC* v. *Polar Pad LLC, d/b/a Polar Drifter, d/b/a Polar Pad, and Veterinary Internet Company, LLC, d/b/a VetInternetCo*, Case: 1:16-cv-00677-RP, Document #11, Aug. 19, 2016, 12 pages.
United States District Court Western District of Texas Austin Division, "Complaint," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00128, Document #1, Feb. 12, 2016, 24 pages.
United States District Court Western District of Texas Austin Division, "Complaint," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00677, Document #1, Jun. 10, 2016, 25 pages.
United States District Court Western District of Texas Austin Division, "Order," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00128-RP, Document #17, Jun. 17, 2016, 1 page.
United States District Court Western District of Texas Austin Division, "[Proposed] Order Granting Stipulated Motion to Dismiss Defendant Polar Pad, LLC, Without Prejudice, Pursuant to Fed. R. Civ. P. 21," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00677-RP, Document #14, Sep. 15, 2016, 1 page.

(56) References Cited

OTHER PUBLICATIONS

United States District Court Western District of Texas Austin Division, "Complaint," *YETI Coolers, LLC* v. *Vickery Products, LLC d/b/a Axis Cups, f/d/b/a Frio Cups*, Case: 1:17-cv-00260, Document #1, Mar. 24, 2017, 52 pages.
United States District Court Western District of Texas Austin Division, "First Amended Complaint," *YETI Coolers, LLC* v. *Wal-Mart Stores, Inc. and Olympia Tools International, Inc.*, Case: 1:16-cv-00454-RP, Document #17, May 24, 2016, 26 pages.
United States District Court Western District of Texas Austin Division, "Complaint," *YETI Coolers, LLC* v. *Wal-Mart Stores, Inc.*, Case: 1:16-cv-00454, Document #1, Apr. 8, 2016, 29 pages.
United States District Court Western District of Texas Austin Division, "Olympia Tools International, Inc.'s Answer to YETI Coolers, LLC's First Amended Complaint," *YETI Coolers, LLC* v. *Wal-Mart Stores, Inc. and Olympia Tools International, Inc.*, Case: 1:16-cv-00454-RP, Document #28, Jul. 14, 2016, 12 pages.
United States District Court Western District of Texas Austin Division, "Wal-Mart Stores, Inc.'s Answer to First Amended Complaint," *YETI Coolers, LLC* v. *Wal-Mart Stores, Inc. and Olympia Tools International, Inc.*, Case: 1:16-cv-00454-RP, Document #22, Jun. 7, 2016, 13 pages.
United States District Court Western District of Texas Austin Division, "Plaintiffs' Complaint for Damages and Injunctive Relief," *YETI Coolers, LLC* v. *Seth Stevens d/b/a SDS Marketing d/b/a Eskimo Coolers, Panther Group LLC d/b/a Eskimo Coolers, Panther Group Sales, LLC d/b/a Eskimo Coolers, and Silver Fox Sales, LLC*, Case 1:17-cv-00423, Document 1, filed May 5, 2017, 77 pages.
United States District Court Western District of Texas Austin Division, "Second Amended Complaint," *YETI Coolers, LLC* v. *Sam's West, Inc., and Sam's East, Inc., and CY Top, Ltd.*, Case: 1:16-cv-00829-RP, Document #51, filed Sep. 22, 2017, 49 pages.
United States District Court Western District of Texas Austin Division, "Complaint," *YETI Coolers, LLC* v. *Bonanza.com, Inc.*, Case: 1:17-cv-00935, Document #1, filed Sep. 28, 2017, 142 pages.
United States District Court Western District of Texas Austin Division, "Complaint," *YETI Coolers, LLC* v. *Alibaba Group Holding Limited, Alibaba (China) Technology Co., Ltd., Alibaba.com Hong Kong Limited, Alibaba.com Singapore E-Commerce Private Limited, Hangzhou Alibaba Advertising Co. Ltd., and Huizhou Dashu Trading Co., Ltd*, Case: 1:17-cv-00936, Document #1, filed Sep. 28, 2017, 272 pages.
"Hooler the handheld cooler", published on Apr. 12, 2014, retrieved from https://web.archive.org/web/20140412062054/http://www.hoolercooler.com/ on Aug. 4, 2015.
United States District Court Western District of Texas Austin Division, "Complaint for Damages and Injunctive Relief," *YETI Coolers, LLC* v. *Jennifer Leverne Bootz Evans d/b/a Bling and Burlap Buy In's and Blanks*, Case: 1:15-cv-00995, Document #1, filed Nov. 2, 2015, 128 pages.
United States District Court Western District of Texas Austin Division, "Order Dismissing Case," *YETI Coolers, LLC* v. *Jennifer Leverne Bootz Evans d/b/a Bling and Burlap Buy In's and Blanks*, Case: 1:15-cv-00995-RP, Document #18, filed Apr. 18, 2016, 1 page.
United States District Court Western District of Texas Austin Division, "Complaint for Damages and Injunctive Relief," *YETI Coolers, LLC* v. *RTIC Coolers, LLC*, Case: 1:16-cv-00264, Document #1, filed Mar. 2, 2016, 34 pages.
United States District Court Western District of Texas Austin Division, "Defendants' Answer and Counterclaims to YETI's First Amended Complaint for Damages and Injunctive Relief," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #25, filed Jun. 13, 2016, 42 pages.
United States District Court Western District of Texas Austin Division, "YETI Coolers, LLC's First Amended Complaint," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #15, filed May 16, 2016, 110 pages.
United States District Court Western District of Texas Austin Division, "Complaint for Damages and Injunctive Relief," *YETI Coolers, LLC* v. *Tree Leaf Marketing, LLC, d/b/a Big Frig*, Case: 1:16-cv-00699, Document #1, filed Jun. 17, 2016, 33 pages.
United States District Court Western District of Texas Austin Division, "Complaint for Damages and Injunctive Relief," *YETI Coolers, LLC* v. *Wal-Mart Stores, Inc.*, Case: 1:16-cv-00454, Document #1, filed Apr. 8, 2016, 29 pages.
United States District Court Western District of Texas Austin Division, "Joint Rule 26(f) Report and Discovery Plan," *YETI Coolers, LLC* v. *Wal-Mart Stores, Inc. and Olympia Tools International, Inc.*, Case: 1:16-cv-00454-RP, Document 29, filed Jul. 28, 2016, 8 pages.
United States District Court Western District of Texas Austin Division, "Olympia Tools International, Inc.'s Answer to YETI Coolers, LLC's First Amended Complaint," *YETI Coolers, LLC* v. *Wal-Mart Stores, Inc. and Olympia Tools International, Inc.*, Case: 1:16-cv-00454-RP, Document #28, filed Jul. 14, 2016, 12 pages.
United States District Court Western District of Texas Austin Division, "Wal-Mart Stores, Inc.'s Answer to First Amended Complaint," *YETI Coolers, LLC* v. *Wal-Mart Stores, Inc. and Olympia Tools International, Inc.*, Case: 1:16-cv-00454-RP, Document #22 filed Jun. 7, 2016, 13 pages.
United States District Court Western District of Texas Austin Division, "First Amended Complaint for Damages and Injunctive Relief," *YETI Coolers, LLC* v. *Wal-Mart Stores, Inc. and Olympia Tools International, Inc.*, Case: 1:16-cv-00454-RP, Document #17, filed May 24, 2016, 26 pages.
"Siskiyou Sports CCS48F Oklahoma Sooners Flame Can Cooler", published on Jul. 9, 2014, retrieved from <http://www.sears.com/siskiyou-sports-ccs48f-oklahoma-sooners-flame-can-cooler/p-SPM7376348303> on Sep. 16, 2016.
"Mini Keg Coozies! Beer Inside Kegs!", published by Chad Dukes on Dec. 18, 2013, retrieved from <http://beerandpig.com/category/beer/page/2/> on Sep. 16, 2016.
"Stainless Steel Can Cooler", published on Apr. 6, 2014, retrieved from <http://www.belpromo.com/nd/detail.php?c=348&p=KZSS001&s=mvp23g56> on Sep. 22, 2016.
"Stanley Vacuum Insulated Container—Thermos bottle", published on Feb. 24, 2012, retrieved from <https://www.youtube.com/watch?v=UCMjqZiNU3o> on Sep. 23, 2016.
United States District Court Western District of Texas Austin Division, "Complaint for Damages and Injunctive Relief," *YETI Coolers, LLC* v. *Magnum Solace LLC*, Case: 1:16-cv-00663-RP, Document #1, filed Jun. 7, 2016, 24 pages.
United States District Court Western District of Texas Austin Division, "Joint Rule 26(f) Report and Discovery Plan," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #26, filed Jun. 23, 2016, 7 pages.
United States District Court Western District of Texas Austin Division, "Defendant's Rule 12(B)(6) Motion to Dismiss," *YETI Coolers, LLC* v. *Magnum Solace LLC*, Case: 1:16-cv-00663-RP, Document #10, filed Aug. 5, 2016, 30 pages.
United States District Court Western District of Texas Austin Division, "YETI's Opposition to Defendant's Motion to Dismiss," *YETI Coolers, LLC* v. *Magnum Solace LLC*, Case: 1:16-cv-00663-RP, Document #12, filed Aug. 19, 2016, 47 pages.
United States District Court Western District of Texas Austin Division, "Complaint for Damages and Injunctive Relief," *YETI Coolers, LLC* v. *MyCrew, LLC, MyCrew Drinkware, LLC, and NNRiverLife, LLC*, Case: 1:16-cv-01008, Document #1, filed Aug. 26, 2016, 29 pages.
United States District Court Western District of Texas Austin Division, "Defendant's Reply in Support of its Rule 12(B)(6) Motion to Dismiss," *YETI Coolers, LLC* v. *Magnum Solace LLC*, Case: 1:16-cv-00663-RP, Document #13, filed Aug. 29, 2016, 18 pages.

(56) References Cited

OTHER PUBLICATIONS

United States District Court Western District of Texas Austin Division, "YETI's Supplemental Brief in Opposition to Magnum's Motion to Dismiss," *YETI Coolers, LLC* v. *Magnum Solace LLC*, Case: 1:16-cv-00663-RP, Document #16, filed Sep. 27, 2016, 7 pages.
United States District Court Western District of Texas Austin Division, "Defendant's Opposed Motion for a Protective Order and Stay of Discovery," *YETI Coolers, LLC* v. *Magnum Solace LLC*, Case: 1:16-cv-00663-RP, Document #17, filed Oct. 3, 2016, 47 pages.
United States District Court Western District of Texas Austin Division, "YETI's Opposition to Magnum's Motion for a Protective Order and Stay of Discovery," *YETI Coolers, LLC* v. *Magnum Solace LLC*, Case: 1:16-cv-00663-RP, Document #20, filed Oct. 11, 2016, 16 pages.
United States District Court Western District of Texas Austin Division, "Defendant's Reply in Support of its Motion for a Protective Order and Stay of Discovery," *YETI Coolers, LLC* v. *Magnum Solace LLC*, Case: 1:16-cv-00663-RP, Document #22, filed Oct. 18, 2016, 5 pages.
JPO Prior art Reference No. HJ20071600.
English translation of Office Action dated Oct. 18, 2016 for JP Application No. 2016-004372, 3 pages.
English translation of Office Action dated Oct. 18, 2016 for JP Application No. 2016-004373, 3 pages.
United States District Court Western District of Texas Austin Division, "Complaint," *YETI Coolers, LLC* v. *Imagen Brands, LLC, d/b/a Crown Products, and Ebsco Industries, Inc*., Case 1:16-cv-00578-RP, Document #1, filed May 16, 2016, 20 pages.
United States District Court Western District of Texas Austin Division, "Defendants' Motion to Dismiss Pursant to Rule 12(b)(6)," *YETI Coolers, LLC* v. *Imagen Brands, LLC, d/b/a Crown Products, and Ebsco Industries, Inc*., Case 1:16-cv-00578-RP, Document #8, filed Oct. 4, 2016, 27 pages.
United States District Court Western District of Texas Austin Division, "YETI Coolers LLC's Answer to RTIC Drinkware, LLC's, RTIC Web Services, LLC's, Corporate Support & Fulfillment, LLC's, John Jacobsen's, and James Jacobsen's Counterclaims," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #31, filed Jul. 7, 2016, 7 pages.
United States District Court Western District of Texas Austin Division, "Defendants' Answer to Plaintiff's Complaint and Affirmative Defenses," *YETI Coolers, LLC* v. *MyCrew, LLC, MyCrew Drinkware, LLC and NNRiverLife, LLC*, Case 1:16-cv-01008-RP, Document #14, filed Nov. 29, 2016, 12 pages.
United States District Court Western District of Texas Austin Division, "Answer," *YETI Coolers, LLC* v. *Tree Leaf Marketing, LLC, d/b/a Big Frig*, Case: 1:16-cv-00699, Document #11, filed Oct. 21, 2016, 8 pages.
"YETI Press Release—Rambler Lowball", published on Jul. 15, 2015, retrieved from <http://yeti.com/press-releases/yeti-coolers-unveils-new-rambler-lowball> on Mar. 14, 2017.
"Bekith Kids Water Mugs Stainless Steel Drinking Cups Double Wall Food Grade Durable Safe—Set of 2", published date unknown but at least as early as Mar. 14, 2017, retrieved from <https://www.amazon.com/Bekith-Stainless-Drinking-Double-Durable/dp/B019JNKG7A/ref=pd_sim_79_5?_encoding=UTF8&psc=1&refRID=ZP054HJK7VYT6T39DSYN> on Mar. 14, 2017.
"Camp Cup", published date unknown but at least as early as Mar. 13, 2017, retrieved from <https://www.miir.com/collections/camp/products/campcup> on Mar. 13, 2017.
"Chinook Timberline Double-wall 12.5 Ounces Mug", published date unknown but at least as early as Mar. 14, 2017, retrieved from <https://www.amazon.com/Chinook-Timberline-Double-wall-12-5-Ounces/dp/B0026ICO8U/ref=pd_sim_79_3?_encoding=UTF8&psc=1&refRID=C586FMMXYCY44F2AZCJB> on Mar. 14, 2017.
"Double Wall Copper Coffee Mug", published date unknown but at least as early as Mar. 14, 2017, retrieved from <http://www.williamssonoma.com/products/1614242/?catalogId=27&sku=1614242&cm_ven=Google_PLA&cm_cat=Shopping&cm_pla=default&cm_ite=default&kwid=productads-adid%5E45527543503-device%5Ec-plaid%5E83089551703-sku%5E1614242-adType%5EPLA&gclid=CIGFx4v9g9ECFYeEsw> on Mar. 14, 2017.
"Double Wall Stainless Steel Beer Mug", published date unknown but at least as early as Mar. 14, 2017, retrieved from <https://www.vat19.com/item/stainless-steel-beer-mug> on Mar. 14, 2017.
"Woodcraft 15oz Shop Mug Insulated Stainless Steel", published date unknown but at least as early as Mar. 14, 2017, retrieved from <https://www.amazon.com/Woodcraft-15oz-Insulated-Stainless-Steel/dp/B004TQGHOS/ref=pd_sim_79_3?_encoding=UTF8&psc=1&refRID=EYMWNJTCKACXEY8YGJMJ> on Mar. 14, 2017.
"YETI Press Release—Rambler Colster", published on Jan. 8, 2015, retrieved from <http://yeti.com/press-releases/rambler-colster> on Mar. 27, 2017.
United States District Court Western District of Texas Austin Division, "Plaintiff YETI Coolers, LLC's Original Complaint," *YETI Coolers, LLC* v. *Ontel Products Corporation and World Pack USA, LLC*, Case: 1:17-cv-00091-RP, Document #1, filed Feb. 8, 2017, 65 pages.
United States District Court Western District of Texas Austin Division, "Defendants' Answers and Defenses to Plaintiff's Original Complaint," *YETI Coolers, LLC* v. *Ontel Products Corporation and World Pack USA, LLC*, Case: 1:17-cv-00091-RP, Document #14, filed Feb. 21, 2017, 45 pages.
United States District Court Western District of Texas Austin Division, "Complaint for Damages and Injunctive Relief," *YETI Coolers, LLC* v. *Tree Leaf Marketing, LLC, d/b/a Big Frig*, Case: 1:16-cv-00699-RP, Document #26, filed Apr. 7, 2017, 39 pages.
Snow Peak H860, posted by copperbrier at YouTube.com [online], posted on Nov. 13, 2013. Available on the Internet, <URL: https://youtu.be/rotGiNYY6ms>.
Snow Peak 450ml, posted by keegansreviews at YouTube.com [online], posted on Jun. 5, 2015. Available on the Internet, <URL: https://youtu.be/S9dSBijmxsM>.
"Snow Peak Detail Specs", published earlier than Jan. 6, 2014, retrieved from <http://global.rakuten.com/en/store/mitsuyoshi/item/tw-137-snowpeak/> on May 22, 2017.
United States District Court Western District of Texas Austin Division, "Complaint," *YETI Coolers, LLC* v. *Wadley Holdings, LLC d/b/a Meadowcraft, and Southern Sales & Marketing Group, Inc. d/b/a/ nICE*, Case 1:17-cv-00421, Document 1, filed May 5, 2017, 121 pages.
United States District Court Western District of Texas Austin Division, "Complaint," *YETI Coolers, LLC* v. *JDS Industries, Inc., Lionel Laundry Jr., d/b/a Accolades Awards & Engraving, Creating and Fast LLC d/b/a Promotional Products San Antonio, Kelly Scoggins d/b/a King Engraving, Jamey Z. Apps d/b/a Roberts Trophies, and Eagle Media, Inc*., Case 1:17-cv-00424, Document 1, filed May 5, 2017, 62 pages.
United States District Court Western District of Texas Austin Division, "Complaint," *YETI Coolers, LLC* v. *Glacier Coolers, LLC, and Tecomate Holdings, LLC*, Case 1:17-cv-00586, Document 1, filed Jun. 15, 2017, 161 pages.
United States District Court Western District of Texas Austin Division, "Complaint," *YETI Coolers, LLC* v. *Gametime Sidekicks, LLC*, Case 1:17-cv-00413, Document 1, filed May 5, 2017, 107 pages.
United States District Court Western District of Texas Austin Division, "Complaint," *YETI Coolers, LLC* v. *Kodiak Coolers, LLC and Flexible Automation LLC*, Case 1:17-cv-00422, Document 1, filed May 5, 2017, 51 pages.
United States District Court Western District of Texas Austin Division, "Complaint," *YETI Coolers, LLC* v. *Gourmet Home Products, LLC*, Case: 1:17-cv-00533, Document #1, filed Jun. 2, 2017, 25 pages.
United States District Court Western District of Texas Austin Division, "Complaint," *YETI Coolers, LLC* v. *Godinger Silver Art,*

(56) References Cited

OTHER PUBLICATIONS

*Ltd., Cathy's Concepts, Inc., Viatek Consumer Products Group, Inc.*, Case: 1:17-cv-00467, Document #1, filed May 16, 2017, 22 pages.
United States District Court Western District of Texas Austin Division, "Complaint," *YETI Coolers, LLC* v. *Bayou Ice Boxes, Inc.*, Case: 1:17-cv-00261, Document #1, filed Mar. 24, 2017, 41 pages.
United States District Court Western District of Texas Austin Division, "Complaint," *YETI Coolers, LLC* v. *Vickery Products, LLC d/b/a Axis Cups, f/d/b/a Frio Cups*, Case: 1:17-cv-00260, Document #1, filed Mar. 24, 2017, 52 pages.
United States District Court Western District of Texas Austin Division, "Complaint," *YETI Coolers, LLC* v. *Benner China and Glassware Florida, Inc.*, Case: 1:16-cv-00142-RP, Document #1, filed Feb. 16, 2016, 21 pages.
United States District Court Western District of Texas Austin Division, "Complaint," *YETI Coolers, LLC* v. *Blackbird Products Group, LLC, d/b/a Mammoth Coolers*, Case: 1:15-cv-01105, Document #1, filed Dec. 7, 2015, 266 pages.
United States District Court Western District of Texas Austin Division, "Defendant Blackbird Products Group, LLC's Answer and Affirmative Defenses to Plaintiff YETI Coolers, LLC's Complaint," *YETI Coolers, LLC* v. *Blackbird Products Group, LLC, d/b/a Mammoth Coolers*, Case: 1:15-cv-01105-SS, Document #13, filed Dec. 28, 2015, 11 pages.
United States District Court Western District of Texas Austin Division, "Order," *YETI Coolers, LLC* v. *Blackbird Products Group, LLC, d/b/a Mammoth Coolers*, Case: 1:15-cv-01105-RP, Document #26, filed Apr. 20, 2016, 1 page.
United States District Court Western District of Texas Austin Division, "Complaint," *YETI Coolers, LLC* v. *The Boelter Companies, Inc., Boelter Brands, LLC and Boelter Beverage, LLC*, Case: 1:16-cv-00456, Document #1, filed Apr. 8, 2016, 20 pages.
United States District Court Western District of Texas Austin Division, "Defendants' Answer to Complaint," *YETI Coolers, LLC* v. *The Boelter Companies, Inc., Boelter Brands, LLC and Boelter Beverage, LLC*, Case: 1:16-cv-00456-RP, Document #21, filed Jun. 7, 2016, 9 pages.
United States District Court Western District of Texas Austin Division, "Consent Judgment," *YETI Coolers, LLC* v. *The Boelter Companies, Inc., Boelter Brands, LLC and Boelter Beverage, LLC*, Case: 1:16-cv-00456-RP, Document #25, filed Sep. 13, 2016, 3 pages.
United States District Court Western District of Texas Austin Division, "Complaint," *YETI Coolers, LLC* v. *Jennifer Leverne Bootz Evans d/b/a Bling and Burlap Buy In's and Blanks*, Case: 1:15-cv-00995, Document #1, filed Nov. 2, 2015, 128 pages.
United States District Court Western District of Texas Austin Division, "Order," *YETI Coolers, LLC* v. *Jennifer Leveme Bootz Evans d/b/a Bling and Burlap Buy In's and Blanks*, Case: 1:15-cv-00995-RP, Document #18, filed Apr. 18, 2016, 1 page.
United States District Court Western District of Texas Austin Division, "Defendant Kaiser Group Inc.'s Answer, Affirmative Defenses, and Counterclaims to Plaintiff YETI Coolers, LLC's Complaint," *YETI Coolers, LLC* v. *Kaiser Group Inc., d/b/a Thermo Steel, d/b/a Vino2Go, d/b/a Brew2GO*, Case: 1:15-cv-00725-RP, Document #14, filed Oct. 13, 2015, 65 pages.
United States District Court Western District of Texas Austin Division, "Complaint," *YETI Coolers, LLC* v. *Great American Products, Ltd.*, Case: 1:15-cv-00686, Document #1, filed Aug. 6, 2015, 20 pages.
United States District Court Western District of Texas Austin Division, "Order," *YETI Coolers, LLC* v. *Great American Products, Ltd.*, Case: 1:15-cv-00686-RP, Document #25, filed Mar. 14, 2016, 1 page.
United States District Court Western District of Texas Austin Division, "Complaint," *YETI Coolers, LLC* v. *Home Depot U.S.A., Inc., Takeya USA Corporation*, Case: 1:17-cv-00342, Document #1, filed Apr. 12, 2017, 24 pages.
United States District Court Western District of Texas Austin Division, "Complaint," *YETI Coolers, LLC* v. *Ideastage Promotions, LLC, d/b/a Swag Brokers*, Case: 1:15-cv-00774, Document #1, filed Sep. 2, 2015, 22 pages.
United States District Court Western District of Texas Austin Division, "Order," *YETI Coolers, LLC* v. *Ideastage Promotions, LLC, d/b/a Swag Brokers*, Case: 1:15-cv-00774-RP, Document #19, filed Dec. 21, 2015, 1 page.
United States District Court Western District of Texas Austin Division, "Complaint," *YETI Coolers, LLC* v. *Kaiser Group Inc., d/b/a Thermo Steel, d/b/a Vino2GO, d/b/a Brew2Go*, Case: 1:15-cv-00725, Document #1, filed Aug. 19, 2015, 21 pages.
United States District Court Western District of Texas Austin Division, "Complaint," *YETI Coolers, LLC* v. *Kuer Outdoors, LLC*, Case: 1:16-cv-00631, Document #1, filed May 27, 2016, 89 pages.
United States District Court Western District of Texas Austin Division, "Complaint," *YETI Coolers, LLC* v. *Magnum Solace LLC*, Case: 1:16-cv-00663-RP, Document #1, filed Jun. 7, 2016, 24 pages.
United States District Court Western District of Texas Austin Division, "Defendant's Rule 12(B)(6) Motion to Dismiss for Failure to State a Claim," *YETI Coolers, LLC* v. *Magnum Solace LLC*, Case: 1:16-cv-00663-RP, Document #10, filed Aug. 5, 2016, 30 pages.
United States District Court Western District of Texas Austin Division, "Defendant's Answer," *YETI Coolers, LLC* v. *Magnum Solace LLC*, Case: 1:16-cv-00663-RP, Document #34, filed Apr. 13, 2017, 7 pages.
United States District Court Western District of Texas Austin Division, "Complaint," *YETI Coolers, LLC* v. *MyCrew, LLC, MyCrew Drinkware, LLC and NNRiverLife, LLC*, Case: 1:16-cv-01008, Document #1, filed Aug. 26, 2016, 29 pages.
United States District Court Western District of Texas Austin Division, "RTIC Drinkware's First Amended Complaint for Declaratory Judgment," *RTIC Drinkware, LLC* v. *YETI Coolers, LLC*, Case: 1:16-cv-00907-RP, Document #52, filed Nov. 14, 2016, 124 pages.
United States District Court Western District of Texas Austin Division, "YETI Coolers, LLC's Answer to RTIC Drinkware's First Amended Complaint," *RTIC Drinkware, LLC* v. *YETI Coolers, LLC*, Case: 1:16-cv-00907-RP, Document #58, filed Dec. 1, 2016, 15 pages.
United States District Court Western District of Texas Austin Division, "YETI Coolers, LLC's Answer to RTIC Drinkware LLC's Complaint," *RTIC Drinkware, LLC* v. *YETI Coolers, LLC*, Case: 1:16-cv-00907-RP, Document #35, filed Aug. 9, 2016, 27 pages.
United States District Court for the Southern District of Texas Huston Division, "RTIC Drinkware's Original Complaint for Declaratory Judgment, Damages, and Injunctive Relief," *RTIC Drinkware, LLC* v. *YETI Coolers, LLC*, Case: 4:16-cv-01201, Document #1, filed May 2, 2016, 58 pages.
United States District Court Western District of Texas Austin Division, "Order," *RTIC Drinkware, LLC* v. *YETI Coolers, LLC*, Case: 1:16-cv-00907-RP, Document #47, filed Oct. 13, 2016, 3 pages.
United States District Court Western District of Texas Austin Division, "Defendant RTIC Drinkware, LLC, RTIC Web Services, LLC, Corporate Support & Fulfillment, LLC, John Jacobsen, and James Jacobsen's Answer and counterclaims to YETI's First Amended Complaint for Damages and Injunctive Relief," *YETI Coolers, LLC* v. *RTIC Coolers, LLC, RTIC Drinkware, LLC, RTIC Web Services, LLC, Corporate Support & Fulfillment, LLC; John Jacobsen; and James Jacobsen*, Case: 1:16-cv-00264-RP, Document #25, filed Jun. 13, 2016, 42 pages.
United States District Court Western District of Texas Austin Division, "Complaint," *YETI Coolers, LLC* v. *RTIC Coolers, LLC*, Case: 1:16-cv-00264, Document #1, filed Mar. 2, 2016, 34 pages.
United States District Court Western District of Texas Austin Division, "First Amended Complaint," *YETI Coolers, LLC* v. *Sam's West, Inc., and Sam's East, Inc.*, Case: 1:16-cv-00829-RP, Document #32, filed Jan. 9, 2017, 24 pages.
United States District Court Western District of Texas Austin Division, "Defendants Sam's West, Inc. and Sam's East, Inc.'s Answer to Complaint," *YETI Coolers, LLC* v. *Sam's West, Inc., and Sam's East, Inc.*, Case: 1:16-cv-00829-RP, Document #16, filed Aug. 26, 2016, 11 pages.

(56) References Cited

OTHER PUBLICATIONS

United States District Court Western District of Texas Austin Division, "Complaint," *YETI Coolers, LLC* v. *Sam's West, Inc., and Sam's East, Inc*., Case: 1:16-cv-00829, Document #1, Jun. 30, 2016, 21 pages.
United States District Court Western District of Texas Austin Division, "First Amended Complaint," *YETI Coolers, LLC* v. *Sic Products LLC, d/b/a Sic Cups, d/b/a Sic*, Case: 1:16-cv-00117-RP, Document #34, Nov. 21, 2016, 25 pages.
United States District Court Western District of Texas Austin Division, "Sic Products, LLC's Answer, Affirmative Defenses, and Counterclaims to Plaintiff's Amended Complaint," *YETI Coolers, LLC* v. *Sic Products LLC, d/b/a Sic Cups, d/b/a Sic*, Case: 1:16-cv-00117-RP, Document #35, Dec. 5, 2016, 81 pages.
United States District Court Western District of Texas Austin Division, "Sic Products, LLC's Answer, Affirmative Defenses, and Counterclaims to Plaintiff's Complaint," *YETI Coolers, LLC* v. *Sic Products LLC, d/b/a Sic Cups, d/b/a Sic*, Case: 1:16-cv-00117-RP, Document #14, Jun. 3, 2016, 38 pages.
United States District Court Western District of Texas Austin Division, "Complaint," *YETI Coolers, LLC* v. *Sic Products LLC, d/b/a Sic Cups, d/b/a Sic*, Case: 1:16-cv-00117-RP, Document #1, Feb. 4, 2016, 23 pages.
https://www.amazon.com/InGwest-Active-Life-Bamboo-Coffee/dp/B01M8JSU2U/ref=sr_1_fkmmull_1?keywords=InGwest+Active+Life&qid=1553010206&s=gateway&sr=8-1-fkmrnull (Year 2016).
https://www.amazon.com/dp/B016AX2Z6C/ref=psdc_602608_t2_B014JZM42I (Year: 2015).
https://www.amazon.in/Mayur-Exports-Stainless-Coffee-Silver/dp/B01BGNYHKI/ref=sr_1_8?ie=UTF8&qid=1544130704&sr=8-8&keywords=Mayur+Exports+Stainless, Feb. 2, 2016.
https://www.amazon.in/Hot-Muggs-Lets-Coffee-Multicolour/dp/B005RU7E2A/ref=sr_1_2?ie=UTF8&qid=1544130658&sr=8-2&keywords=hot+muggs+let%27s+coffee+mug, Dec. 20, 2013.
https://www.turbosquid.com/3d-models/stainless-steel-thermal-mug-3d-model/1102021, Jan. 20, 2017.
https://www.amazon.in/Aagam-Palak-Double-Walled-Stainless/dp/B00SOIYFWY/ref=sr_1_?ie=UTF8&qid=1544133439&sr=8-1&keywords=Aagam+%26+Palak+Double, Jan. 24, 2015.
http://www.amazon.in/Pigeon-Stainless-Steel-Coffee-Cup/dp/B01LXFSDOY/ref=sr_1_sc_1?ie=UTF8&qid=1544133520&sr-8-1-spell&keywords=Buy+Pigeon+Stainless+Steel+Coffee+Cup+Set+of+4, Oct. 4, 2016.
https://www.turbosquid.com/3d-models/mug-subdivided-max/692992, Feb. 21, 2018.
http://www.amazon.in/Mayur-Exports-Stainless-Coffee-Silver/dp/B01BGNYHKI/ref=sr_1_8?ie=UTF8&qid=1544130704&sr=8-8&keywords=Mayur+Exports+Stainless (Year: 2016).
United States District Court Western District of Texas Austin Division, "Complaint," *YETI Coolers, LLC* v. *99 Cents Only Stores, LLC and 99 Cents Only Stores Texas, Inc*., Case: 1:18-cv-00799, Document #1, filed Sep. 18, 2018, 102 pages.
United States District Court Western District of Texas Austin Division, "Complaint," *YETI Coolers, LLC* v. *ContextLogic, Inc. d/b/a Wish.com*, Case: 1:17-cv-00937, Document #1, filed Sep. 28, 2017, 238 pages.
United States District Court Western District of Texas Austin Division, "Complaint," *YETI Coolers, LLC* v. *Dunhuang Group, SZ Flowerfairy Technology Co., Ltd., Tan Er Pa Technology Co., Ltd., Shenzhen Great Electronic Technology Co., Ltd., and Huagong Trading Co*., Case: 1:17-cv-00938, Document #1, filed Sep. 28, 2017, 272 pages.
Thermos Stainless Steel 14 Ounce Travel Tumbler with 360 Degree Lid [online], [retrieved Apr. 4, 2018], Retrieved from the Internet, URL: <<https://www.amazon.com/Thermos-Stainless-Travel-Tumbler-Degree/dp/B000FOMQ4O/ref=sr_1_1?ie=UTF8&qid=1522868265&sr=8-1&keywords=thermos+stainless+steel+14+ounce+travel+tumbler+with+360+degree+lid>>, 7 color pages, published date unknown, but for purposes of patent prosecution prior to the filing date of the present application.
Maui Fusion Travel Mug—14 oz. [online], [retrieved Apr. 4, 2018], Retrieved from the Internet, URL: <<https://www.4imprint.com/product/105878/maui-fusion-travel-mug-14-oz>>, 2 color pages, published date unknown, but for purposes of patent prosecution prior to the filing date of the present application.
United States District Court Western District of Texas, Austin Division, "Complaint," *YETI Coolers, LLC* v. *V-Rose Enterprise, LLC* d/b/a Calavera Coolers, Case 1:20-cv-00086. Document 1, filed Jan. 23, 2020, 40 pages.

BEVERAGE HOLDER

CROSS-REFERENCE TO RELATED APPLICATIONS

This patent application relates to U.S. patent application Ser. No. 15/285,268, filed Oct. 4, 2016, entitled Container and Method of Forming a Container which is incorporated by reference herein in its entirety.

TECHNICAL FIELD

Aspects described herein generally relate to beverage holders, and more specifically, relate to a beverage holder including a container and a fastening seal.

BACKGROUND

Beverage holders may be used to provide an insulative buffer between a beverage container (e.g., can, bottle, etc.) and the surrounding environment. However, certain beverage holders may not accommodate beverage containers of a plurality of types and volumes, provide minimal insulative effects, and are susceptible to tearing, ripping, and/or fraying. Thus, there may exist a need for a robust beverage holder capable of receiving a multitude of different beverage containers of varying types and volumes.

SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

In accordance with one or more embodiments, a beverage holder for accommodating different sized beverage containers may comprise a container and a fastening seal. The container may have a first outer wall which may form an outer shell of the container. The first outer wall may have a top portion with a sidewall and a bottom end configured to support the container on a surface. The container may also have a second inner wall which may have a top end and an opening extending into an internal reservoir for receiving the beverage container. The second inner wall may also have a sidewall portion and a bottom portion. The container may further have a sealed vacuum cavity which may form an insulated double wall structure between the first outer wall and the second inner wall. The fastening seal of the beverage holder may have an engagement portion configured to removably engage the sidewall of the first outer wall of the container. The fastening seal may also have a retention portion configured to engage the different sized beverage containers. The retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers These features, along with many others, are discussed in greater detail below.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which aspects described herein may be practiced. It is to be understood that other embodiments may be utilized and structural and functional modifications may be made without departing from the scope of the described aspects and embodiments. Aspects described herein are capable of other embodiments and of being practiced or being carried out in various ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged" and similar terms, is meant to include both direct and indirect mounting, connecting, coupling, positioning and engaging.

Also, while the terms "top," "bottom," "front," "back," "side," "rear," "upward," "downward," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this disclosure.

Figure 1A:
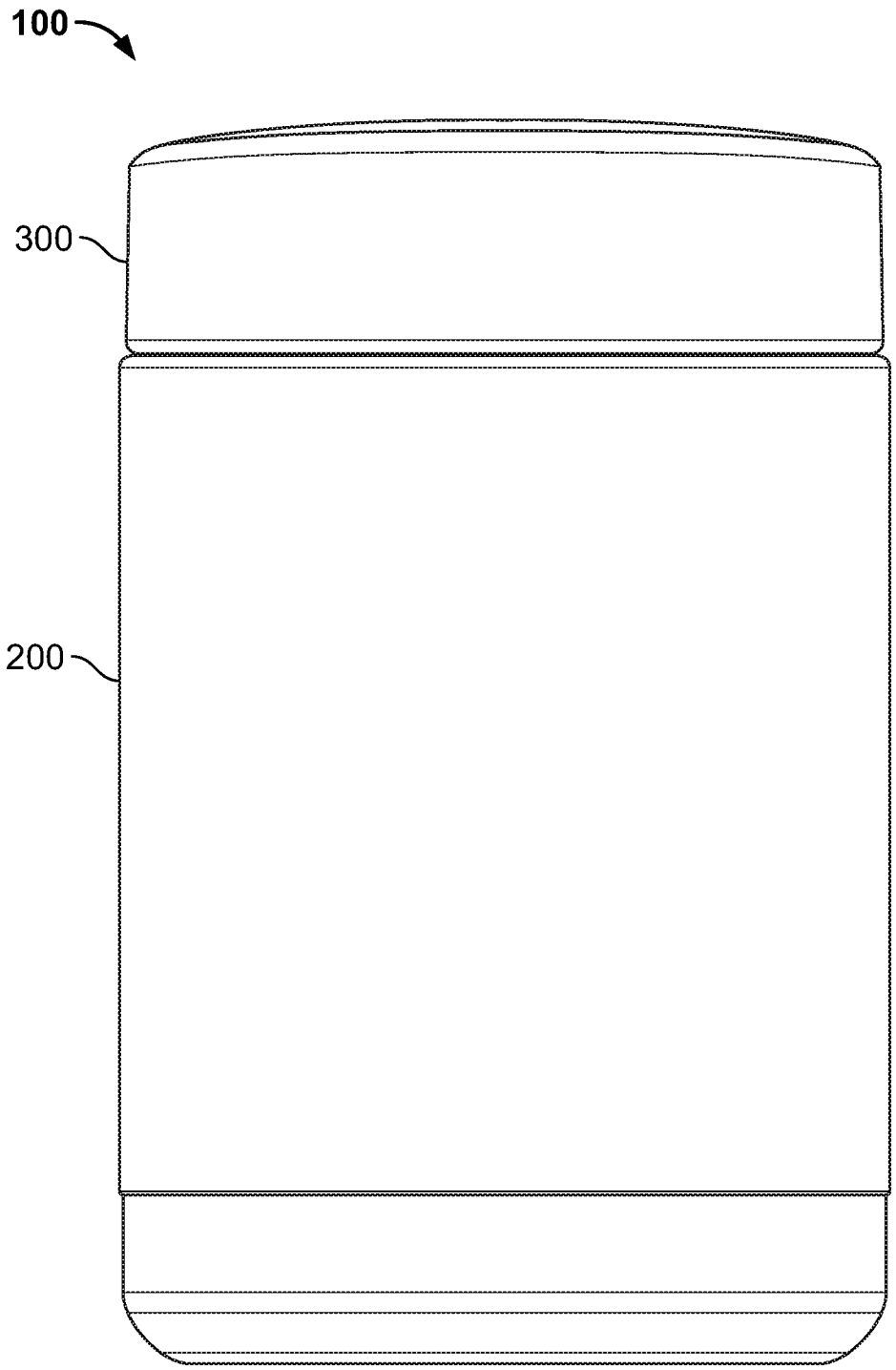
FIG. 1A illustrates a front view of an exemplary beverage holder according to one or more aspects of the disclosure.
Figure 1B:
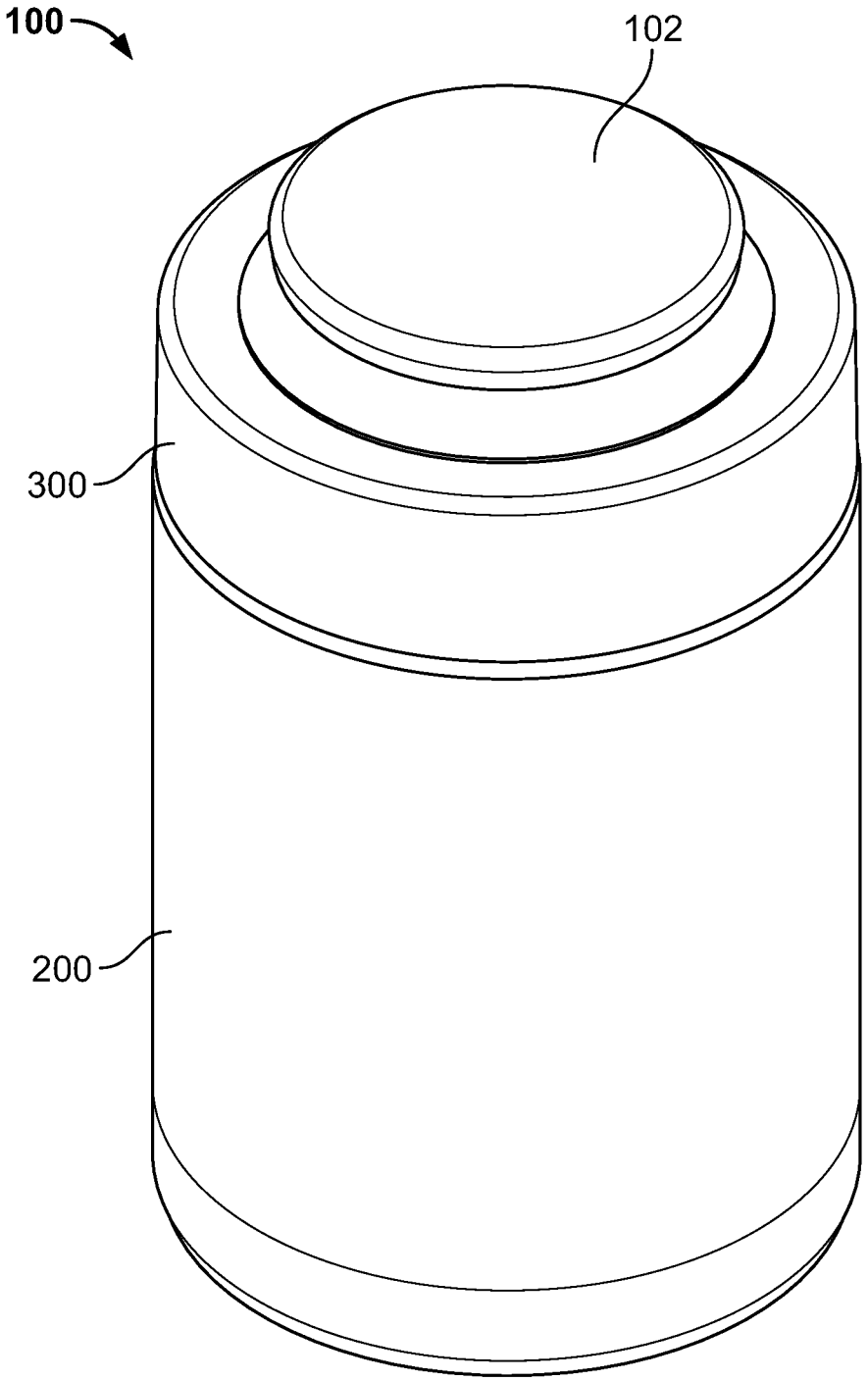
FIG. 1B illustrates an isometric front view of an exemplary beverage holder and a beverage container according to one or more aspects of the disclosure.

FIG. 1A depicts a front view of a beverage holder 100 including a container 200 and a fastening seal 300 according to one or more aspects of the disclosure. The beverage holder 100 may be fabricated in a cylindrical shape from any one, or combination of, metals or alloys thereof (e.g., titanium, stainless steel, aluminum, etc.), plastics (e.g., thermoplastic, thermoset, etc.), and/or composite materials. The beverage holder 100 may be configured to receive, secure, and/or insulate a beverage container (e.g., bottle, can, etc.) of any of a plurality of types and volumes. FIG. 1B depicts an isometric front view of a beverage holder 100 housing a beverage container 102 to one or more aspects of the disclosure.

For example, beverage holder 100 may be configured to accommodate a bottle of any of a plurality of types including, but not limited to, a stubby, steinie, London Brewer's Standard, De Nederlandse Bierfles (e.g., pijpje), industry standard bottle (e.g., longneck), nip, ponie, cuartito, caguama, ballena, throwdown, grenade, and the like. In some embodiments, the volume of the bottle that the beverage holder 100 is able to accommodate may include bottles ranging from 5 US fl oz to 32 US fl oz (e.g., 147.86 mL to 946.35 mL) or 8 US fl oz to 20 US fl oz (e.g., 236.58 mL to 591.47 mL). Furthermore, the beverage holder 100 may be able to accept bottles including diameters ranging from 2 in to 3.36 in (e.g., 5.08 cm to 8.54 cm) and heights ranging from 5 in to 12 in (e.g., 12.7 cm to 30.48 cm). Additionally, beverage holder 100 may be configured to accommodate a can of any of a plurality of types including, but not limited to, flat tops, cone tops, flat bottom inverted rib, j-spouts, self-opening, and the like. In some embodiments, the volume of the can that the beverage holder 100 is able to accommodate may include volumes ranging from 5 US fl oz to 32 US fl oz or 8 US fl oz to 20 US fl oz. Furthermore, the beverage holder 100 may be able to accept cans including diameters ranging from 2 in to 3.36 and heights ranging from 5 in to 12 in.

Figure 2B:
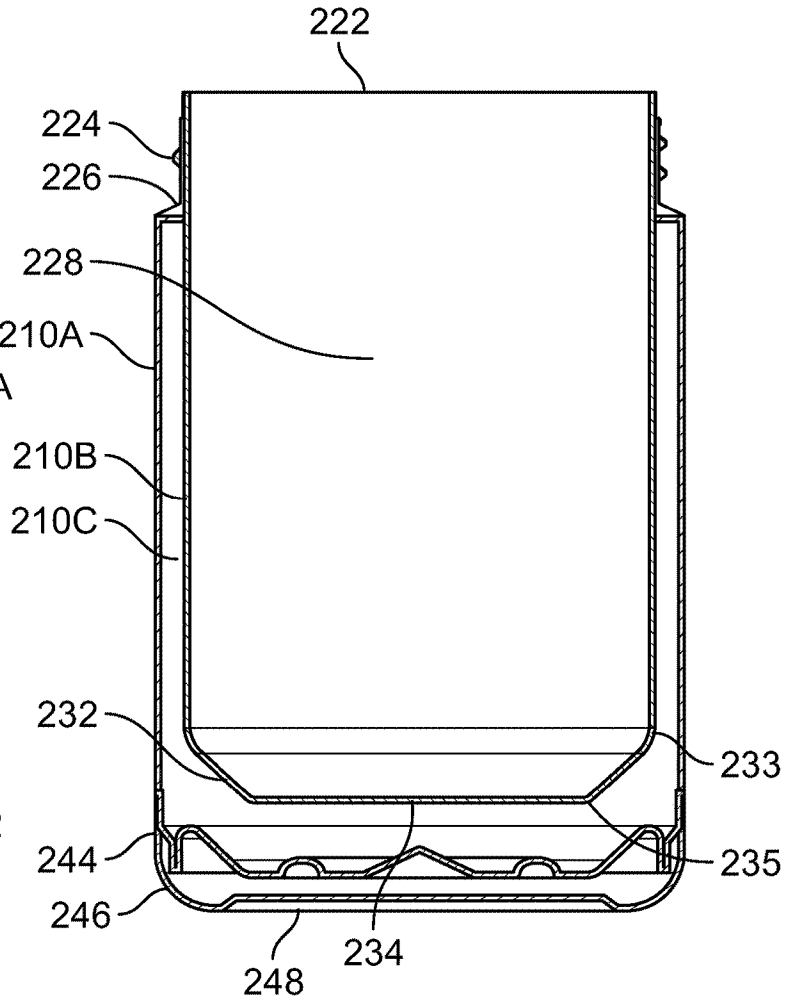
FIG. 2B illustrates a cross-sectional view of container of FIG. 2A.
Figure 2A:
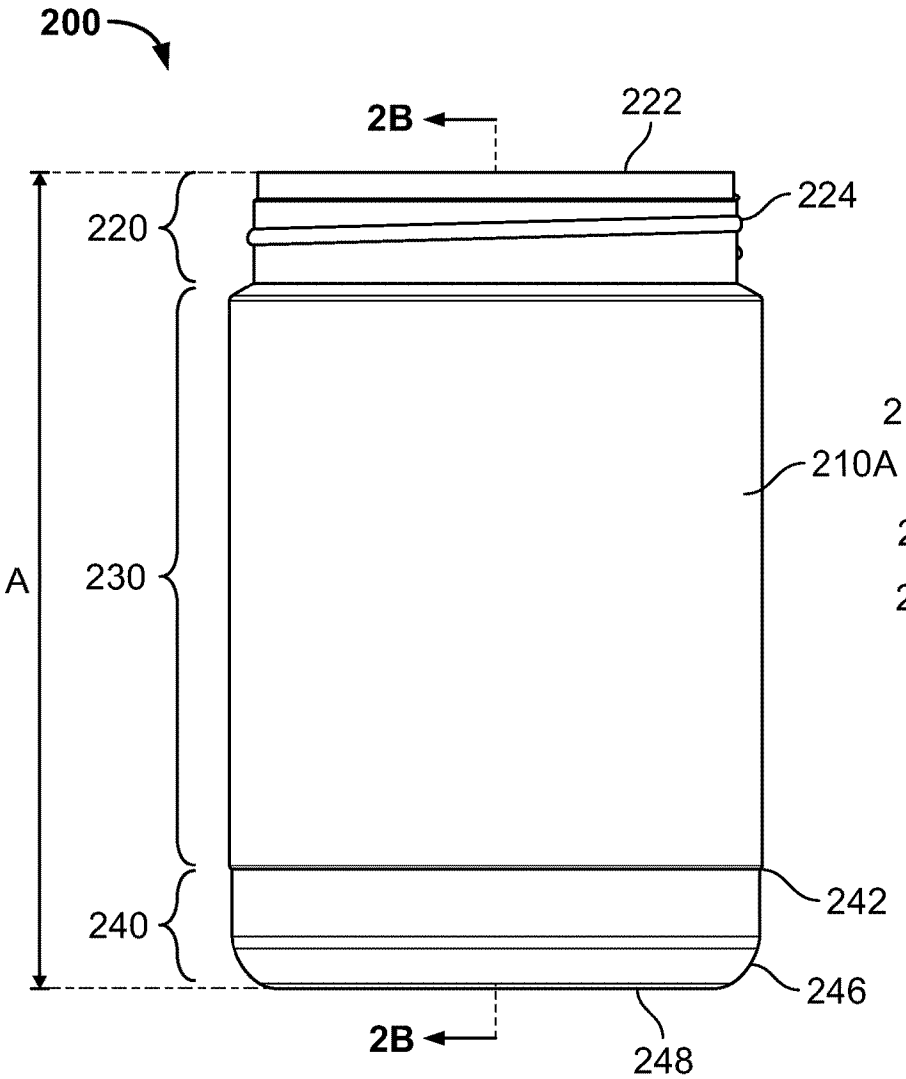
FIG. 2A illustrates a front view of the exemplary container of a beverage holder according to one or more aspects of the disclosure.
Figure 2D:
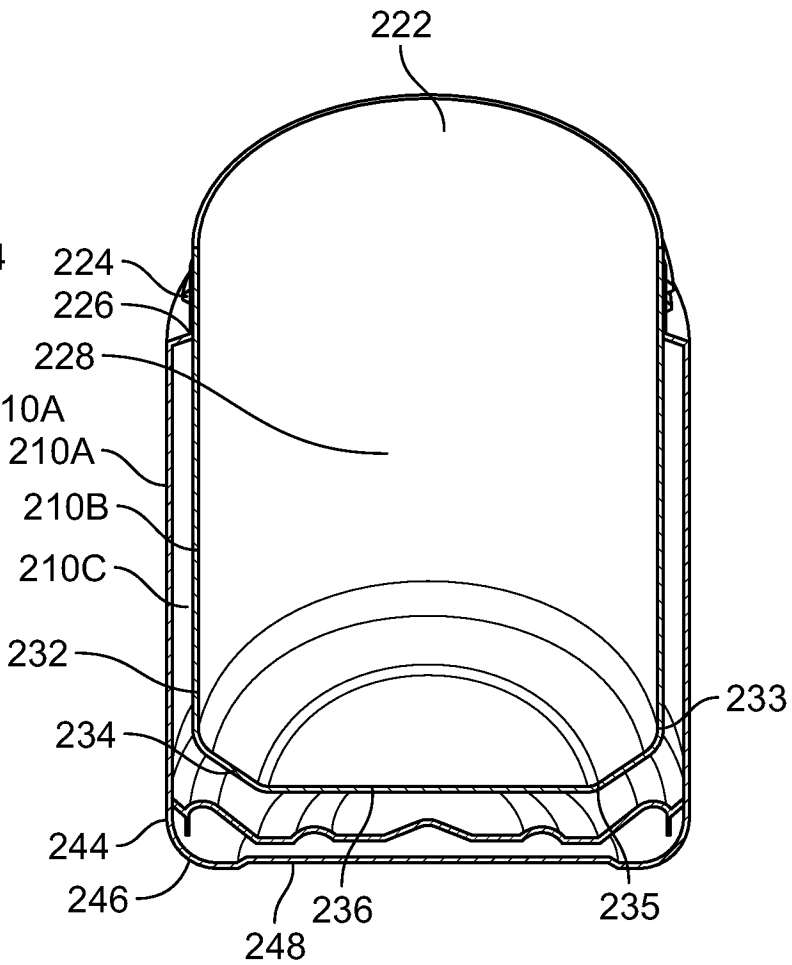
FIG. 2D illustrates a cross-sectional isometric view of the container of FIG. 2A.
Figure 2C:
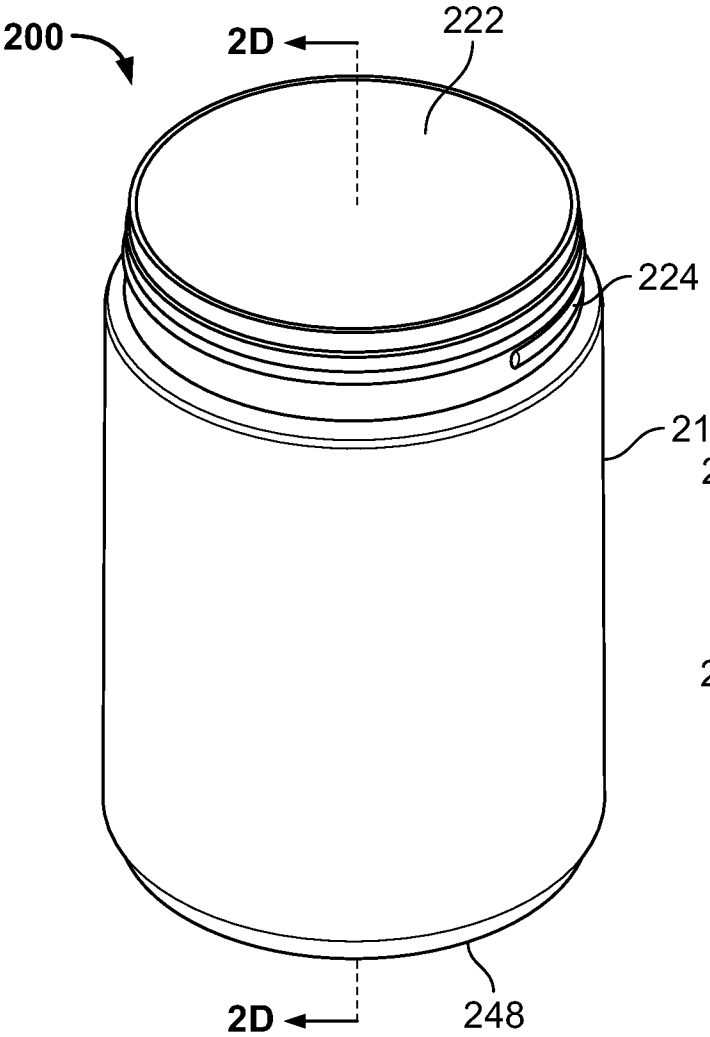
FIG. 2C illustrates an isometric view of the container of FIG. 2A.
Figure 2E:
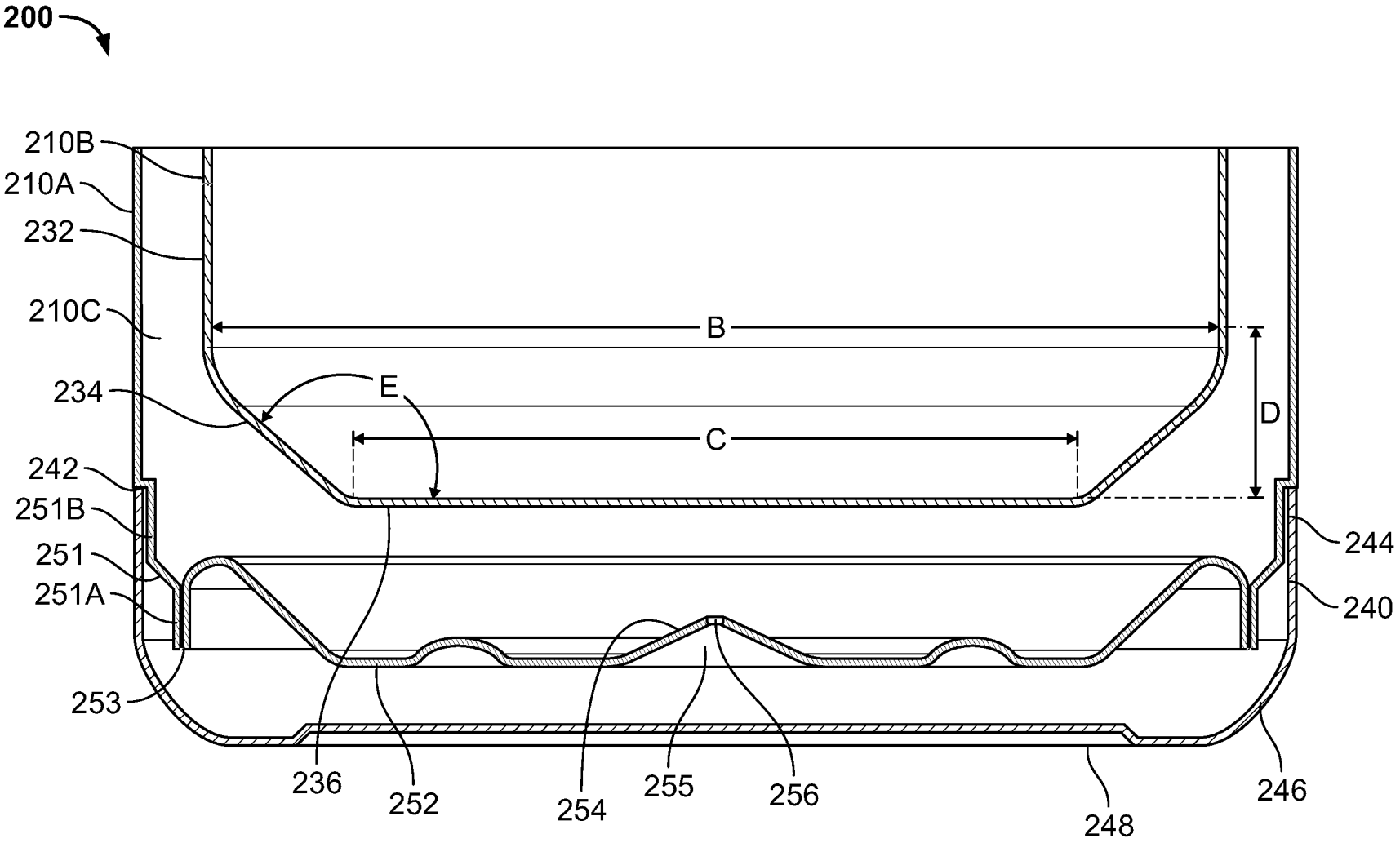
FIG. 2E illustrates a partial and enlarged view of the container of FIG. 2A.

FIGS. 2A and 2B show a front view and a cross-sectional view, respectively, of container 200 of beverage holder 100. FIGS. 2C and 2D show an isometric view and a cross-sectional isometric view, respectively, of the container 200. FIG. 2E shows a partial and enlarged view of the container 200 depicted in FIG. 2B. Container 200 may include a top section/portion 220, middle section/portion 230, and bottom section/portion 240. The container 200 may have a height (designated as dimension "A" in FIG. 2A) of about 4.71 in (e.g., about 11.96 cm), or a height in the range of about 4.47 in to about 4.94 in (e.g., about 11.37 cm to about 12.56 cm), or a height in the range of about 3.76 in to about 5.65 in (e.g., about 9.572 cm to about 14.358 cm). In some instances, the beverage holder may be configured to receive a tallboy can. In such instances, the container 200 may have a height of about 6.08 in (e.g., about 15.46 cm).

In either case, at the top section 220, outer wall 210A may be joined with inner wall 210B. At an uppermost and/or topmost portion of top section 220 may form mouth 222. Mouth 222 may be a cylindrical opening through which a beverage container is configured to enter container 200 into internal reservoir 228.

At the top section 220 of container 200, outer wall 210A may include a fastening ridge 224 and may form threaded sidewall 210A. Fastening ridge 224 may be a protrusion extending from the outer face of threaded sidewall 210A and may spiral around the circumference of the wall 210A of top section 220 from an upper end proximate to mouth 222 to a bottom end proximate to the junction between top section 220 and middle section 230 (e.g., separation point 226). As will be described in further detail below in regards to seal 300, the fastening ridge 224 may be configured interface with a fastening ridge 326 of seal 300. Through the engagement of fastening ridge 224 of container 200 and fastening ridge 326 of seal 300, the container 200 may be secured, attached, and/or fastened to seal 300.

At the intersection (e.g., separation point 226) between top section 220 and middle section 230 of container 200, walls 210A and 210B may separate further to create an insulating volume between walls 210A and 210B. Outer wall 210A may taper away from inner wall 210B in a downward and outward direction at the separation point 226 and the inner wall 210B may progress downward in the axial direction. The separation point 226 at which wall 210A and 210B separate further may mark the termination of top section 220 and beginning of middle section 230.

Outer wall 210A may also be fabricated from one or more metals, including, but not limited to, stainless steel, aluminum, and/or titanium and alloys thereof. Similar to inner wall 210B, outer wall 210A may be fabricated from a plastic or composite material or a combination of metals and alloys thereof, plastics, and/or composite materials. Outer wall 210A may be a cylindrical wall having a thickness of about 0.022 in (e.g., about 0.60 mm) or a thickness in the range of about 0.019 in to about 0.024 in (e.g., about 0.57 mm to about 0.63 mm), or a thickness in the range of about 0.018 in to about 0.028 in (e.g., about 0.48 mm to about 0.72 mm).

Inner wall 210B may be fabricated from one or more metals, including, but not limited to, stainless steel, aluminum, and/or titanium and alloys thereof. Alternatively, inner wall 210B may be fabricated from a plastic or composite material or a combination of metals, plastics, and/or composite materials. Inner wall 210B may be a cylindrical wall having a thickness of about 0.023 in (e.g., about 0.50 mm) or a thickness in the range of about 0.018 in to about 0.020 in (e.g., about 0.48 mm to about 0.53 mm), or a thickness in the range of about 0.015 in to about 0.023 in (e.g., about 0.40 mm to about 0.60 mm). Inner wall 210B may include sidewall 232, tapered portion 234, and interior bottom 236 which may form the boundaries of internal reservoir 228.

At a lower and/or bottom portion of middle section 230 of beverage insulative holder 200, inner wall 210B may include a tapered portion 234. Tapered portion 234 may slope inward and downward from an intersection point 233 with sidewall 232 to an intersection point 235 with interior bottom 236. Stated differently, the diameter of inner wall 210B may be linearly reduced from a maximum diameter (designated as dimension "B" in FIG. 2E) to a minimum diameter (designated as dimension "C" in FIG. 2E) at the termination of tapered portion 234 at interior bottom 236 (e.g., intersection point 235 of tapered portion 234 and interior bottom 236). The maximum diameter (e.g., "B") of inner wall 210B may be about 2.66 in (e.g., about 67.6 mm) or may be in the range of about 2.66 in to about 2.94 in (e.g., about 63.40 mm to about 74.76 mm) or may be in the range of about 2.24 in to about 3.36 in (e.g., about 56.96 mm to about 87.50 mm). The minimum diameter (e.g., "C") of inner wall 210B may be about 1.85 in (e.g., about 47 mm) or may be in the range of about 1.75 in to about 1.94 in (e.g., about 44.65 mm to about 49.35) or may be in the range of about to 1.48 in to about 2.22 in (e.g., about 37.60 mm to about 56.40 mm). As such, the ratio of the maximum diameter "B" of inner wall 210B to the minimum diameter "C" of inner wall 210B may be about 1.51:1 or in the range of about 1.44:1 to about 1.59.1, or in the range of 1.4:1 to 1.5:1, or in the range of about 1.21:1 to about 1.82:1.

The height of the tapered portion 234 (designated as dimension "D" in FIG. 2E) may be about 0.35 in (e.g., about 8.95 mm), or may be in the range of about 0.33 in to about 0.37 in (e.g., about 8.5 mm to about 9.4 mm), or may be in the range of 8 mm to 9 mm, or may be in the range of about 0.30 in to about 0.42 in (e.g., about 7.16 mm to about 10.74 mm). The angle of the tapered portion 234 (designated as angle "E" in FIG. 2E) tapered portion 234 may be about 139°, or may be in the range of about 132.05° to about 145.95°, or may be in the range of about 111.20° to about 166.80°, or may be in the range of 132° to 146°, or may be in the range of 130° to 150°. Interior bottom 234 may be substantially flat.

In one example, the ratio of the height of the container 200 to the height of the tapered section 234 ("A"/"D") may be about 13.37:1 or in the range of about 12.7:1 to about 14.0:1, or in the range of about 10.1:1 to about 16.0:1.

Depending on the diametric size of a beverage container, a bottom and/or bottommost portion of the beverage container inserted into internal reservoir 228 of container 200 may be configured to rest on either interior bottom 236 or the tapered portion 234. As such, the distance between the bottom and/or bottommost portion of the beverage container and a top and/or topmost portion of interior bottom 236 may be linearly related to the bottom and/or bottommost portion of the beverage container. For example, a first beverage container with first diameter may sit higher from the interior bottom 236 than a second beverage container with a second diameter smaller than the first diameter, wherein the first diameter is greater than the diameter of the interior bottom 236. Advantageously, the container 200 having the tapered portion 234 may provide for better holding of a wider range of beverage containers.

Through the combination of tapered portion 234 and the downward and/or inward force applied by seal 300 on a beverage container 102 when fastened to container 200, the rotational and/or linear displacement of the bottom and/or bottommost portion of the beverage container 102 may be prevented or reduced. As such, the beverage container 102 may be secured in beverage holder 100 and the positioning of the beverage container within the interior of container 200 may be maintained. Accordingly, the beverage container may be prevented from jostling inside container 200 and contacting (e.g., hitting, banging, tapping, clinking, etc.) inner wall 210B. It is also contemplated that the inner wall 210B could be provided with a series of concentric ridges that vary in size diametrically. The ridges can be formed with right angles or be angled to accommodate the tapering of different sized beverage containers. In some instances, the interior bottom 236 and the tapered portion 234 may be lined and/or coated with plastic and/or rubber in order to increase the frictional contact between the surfaces of the interior bottom 236 and the tapered portion 234 and a beverage container, as well as to create a cushion between the beverage container and the inner wall 210B comprising the interior bottom 236 and the tapered portion 234. Additionally, the plastic and/or rubber may include an elastic component such that the elasticity of the plastic and/or rubber stretches to grip the bottom end of the container. The inner wall 210B may also be provided with a series of ribs for preventing the bottom end of the beverage container from sliding within the beverage holder. Other high friction coatings are also contemplated such as, for example, texturing, coarsing, abrasioning, dimpling, and the like.

As shown in FIG. 2E, outer wall 210A may include a radially and axially extending flange 251, which includes a first portion 251A and a second portion 251B diverging axially (e.g., vertically) from the flange 251. The first portion 251A receives the bottom section 252 of the outer wall 210A, and the second portion 251B receives end cap 240.

Specifically, the first portion 251A of the flange 251 provides a mounting surface for the bottom section 252 of the outer wall 210A. The bottom section 252 includes a corresponding flange 253 that extends in the axial direction. The bottom section 252 of the outer wall 210A can be press-fit onto the outer wall 210A on the inner face of the first portion 251A of the flange 251, and the flange 253 can be welded to the first portion 251A of the flange 251 by any suitable welding method, such as a laser welding, brazing process, arc welding, or a silver soldering.

The bottom section 252 of the outer wall 210A may include a dimple 254 that is used during the vacuum formation process discussed herein. In this example, the dimple 254 may resemble a dome-like shape. However, as discussed herein, other suitable shapes are contemplated for receiving the resin material during the vacuum formation process such as a cone, or frustoconical shape. The dimple 254 can include an inner portion 255 converging to an opening 256 extending through the outer wall 210A. The opening 256 may be sealed by a resin or other material (not shown). As discussed below, during the formation of the vacuum between the inner wall 210B and the outer wall 210A, the resin seals the opening 256 to create a sealed vacuum cavity in void 210C between the inner wall 210B and the outer wall 210A in formation of the insulated double-wall structure.

The void 210C positioned between outer wall 210A and inner wall 210B may be a vacuum sealed void and may be of a cylindrical arrangement. The thickness of void 210C may be about 0.16 in (e.g., about 4.1 mm), may be in the range of about 0.15 in to about 0.16 in (e.g., about 3.9 mm to about 4.3 mm), or may be in the range of about 0.12 in to about 0.19 in (e.g., about 3.3 mm to about 4.9 mm). The vacuum sealed void 210C may provide an insulative barrier between the interior of container 200 and the external environment. Thus, beverage insulative holder 200 may be a double-wall vacuum insulated beverage holder.

In accordance with the examples discussed herein, implementations of insulating structures that utilize one or more vacuum chambers to reduce heat transfer by conduction, convection and/or radiation may be utilized within the container 200. To achieve a vacuum between the inner wall 210B and outer wall 210A of the container 200, the air within the container 200 may be removed by heating the container 200 within a vacuum and removing the air between the inner wall 210B and outer wall 210A through the opening 256 in the dimple 254 located on the outer wall 210A.

Specifically, the container 200 may be oriented inverted within a vacuum formation chamber, and a resin, which can be in the shape of a pill, can be placed into the dimple 254 during the vacuum forming process. In certain examples, the resin can be approximately 3 mm to 5 mm in diameter, and the opening in the dimple 254 can be approximately 1 mm in size. In this way, when the container 200 is heated the resin becomes viscous so as to not flow or drip into the container through the opening 256, but permeable to air such that the air escapes the internal volume of the container 200. Once the resin cools and solidifies, it covers the opening 256 of the dimple 254 and seals the internal volume of the container 200 to form the vacuum within the container 200.

In some arrangements, other implementations of insulating structures that utilize one or more vacuum chambers to reduce heat transfer by conduction, convection and/or radiation may be utilized within the container 200. For instance, arrangements described in U.S. patent application Ser. No. 15/285,268, filed Oct. 4, 2016, entitled Container and Method of Forming a Container, which is incorporated by reference herein in its entirety, may be used in conjunction with aspects described in the present disclosure.

In some instances, the bottom section 252 of the outer wall 210A may be covered with end cap 240 after the vacuum forming process has been performed. The end cap 240 may correspond to the bottom portion 240 of container 200. The end cap 240 may be secured to the second portion 251B of the flange 251. In particular, a wall 244 of the end cap 240 may be press fit onto the outer surface of the second portion 251B of the flange 251. After the wall 244 of the end cap 240 is press-fit onto the second portion 251B of the flange 251, the wall 244 of the end cap 240 may be welded in place by any suitable welding method, such as a laser welding, brazing process, arc welding, or a silver soldering, to form seam 242. After the end cap 240 is welded into place, the seam 242 may optionally be polished such that it is no longer noticeable to the user.

The wall 244 may progress downwardly from the seam 242 at the transitionary and/or intersection point of the middle portion 230 and the end cap 240 (e.g., bottom portion 240) to end cap bottom 248. Prior to arriving at end cap bottom 248, wall 244 may experience a reduction in diameter at end cap fillet 246. The end cap fillet 246 may have a radius from about 1/32 in to about 1/4 in (e.g., about 0.79 mm to about 6.25 mm) or about 1/16 in to about 1/8 in (e.g., about 1.58 mm to about 3.17 mm) depending on the embodiment. In some instances, end cap bottom 248 may include a plastic and/or rubber coating at a bottommost portion to increase the frictional engagement with an adjacent contact surface and reduce and/or dampen noise propagated through contact with the adjacent contact surface.

Figure 3C:
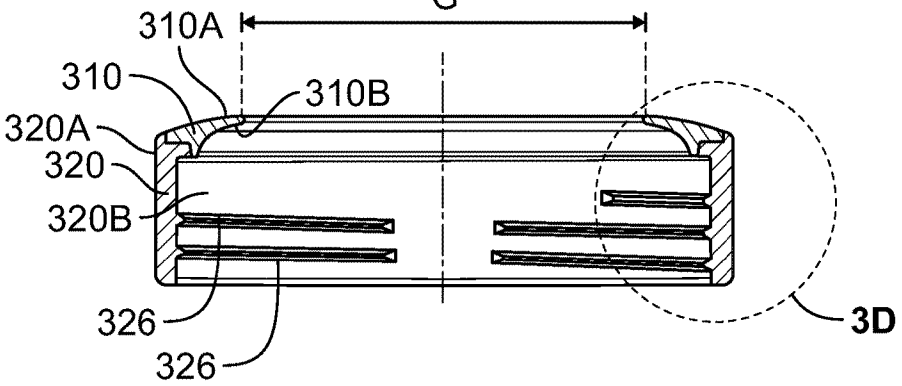
FIG. 3C illustrates a cross-sectional view of the fastening seal of FIG. 3A.
Figure 3D:
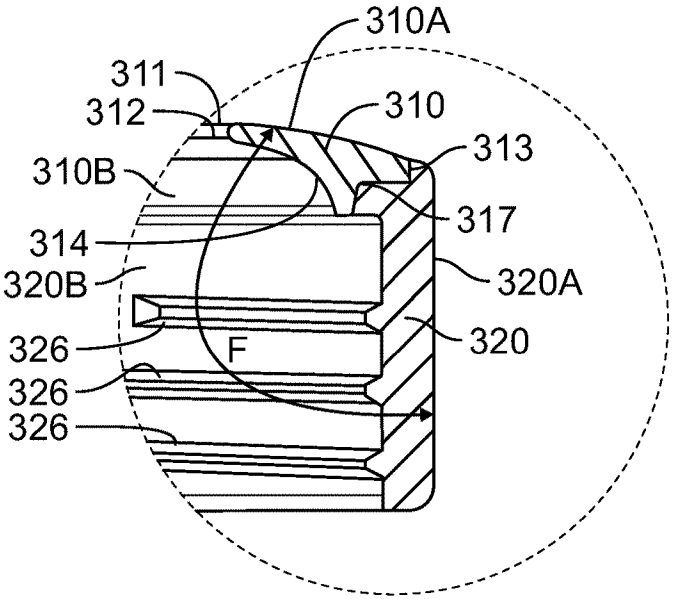
FIG. 3D illustrates an enlarged partial sectional view of the fastening seal of FIG. 3A.
Figure 3A:
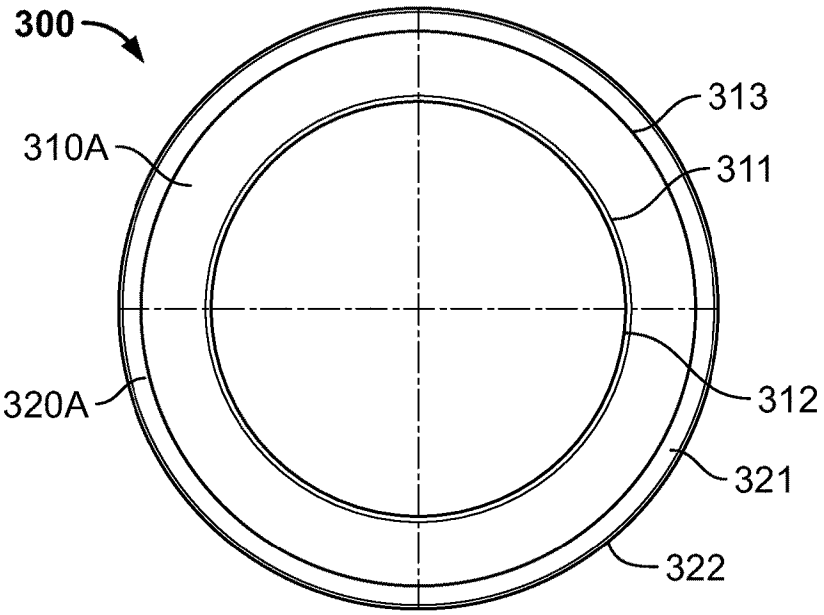
FIG. 3A illustrates a top view of an exemplary fastening seal according to one or more aspects of the disclosure.
Figure 3B:
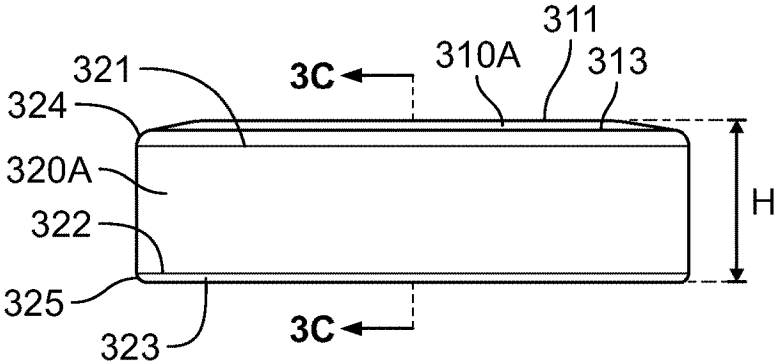
FIG. 3B illustrates a front view of the fastening seal of FIG. 3A.
Figure 3E:
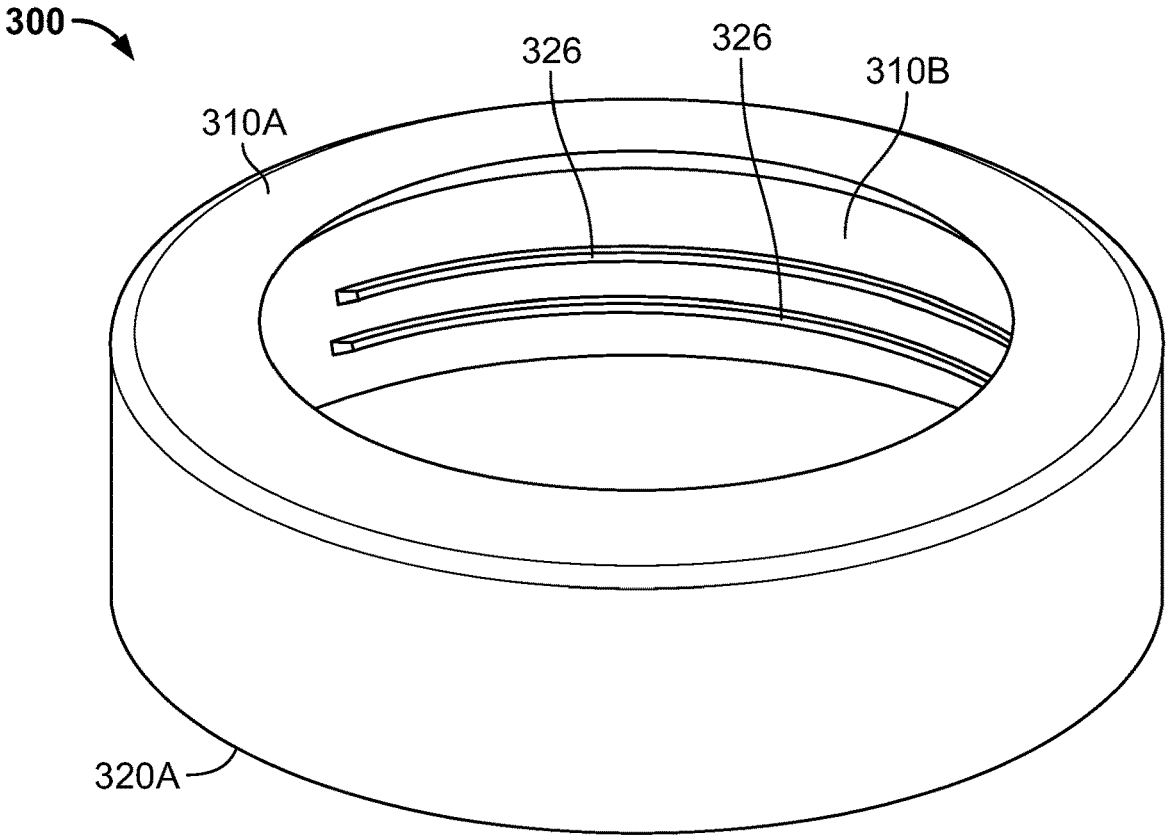
FIG. 3E illustrates a top isometric view an exemplary fastening seal according to one or more aspects of the disclosure.
Figure 3F:
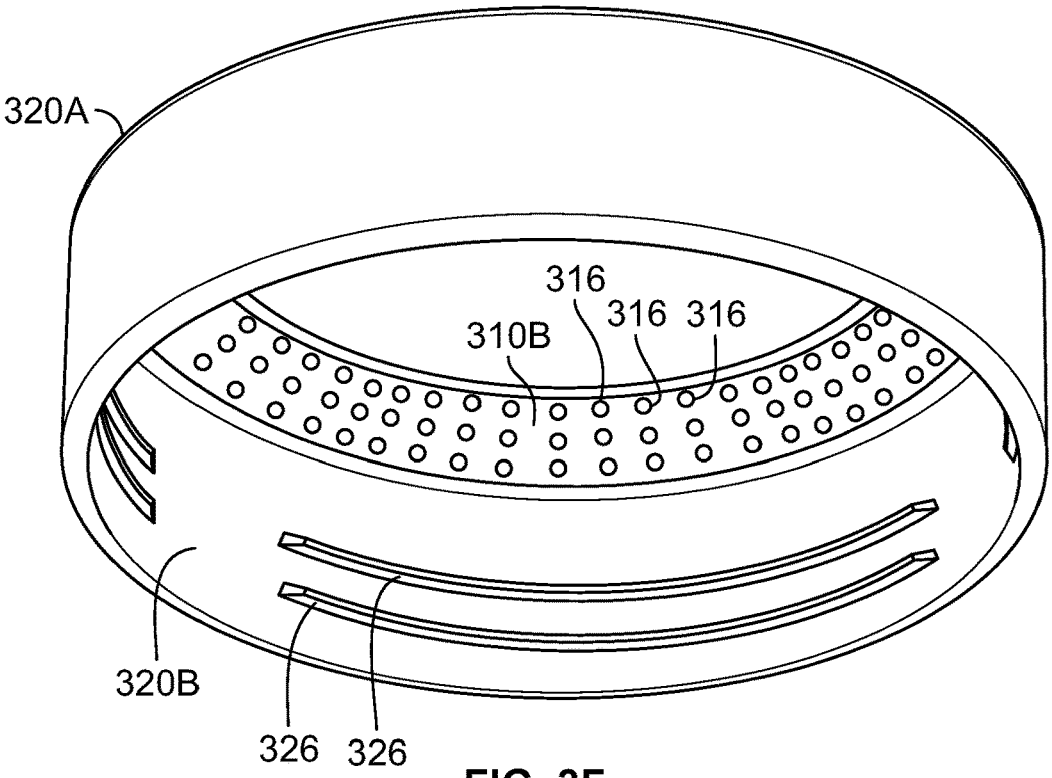
FIG. 3F illustrates a bottom isometric view an exemplary fastening seal according to one or more aspects of the disclosure.

As stated above, seal 300 may be configured to rotatably fasten to container 200. FIGS. 3A, 3B, 3C, and 3D show a top view, front view, cross-sectional view, and sectional view, respectively, of fastening seal 300 of beverage holder 100. FIGS. 3E and 3F show a top isometric view and a bottom isometric view, respectively, of the fastening seal 300. Seal 300 may include an upper retention portion 310 and a bottom engagement portion 320. The fastening seal 300 may have a height (designated by dimension "H" in FIG. 3B) of about 0.9 in (e.g., about 23 mm) or may be in the range of about 0.86 in to about 0.95 in (e.g., about 21.85 mm to about 24.15 mm) or may be in the range of about 0.72 in to about 1.08 in (e.g., 18.40 mm to about 27.60 mm). In some embodiments the ratio of the height of the container 200 to the height of the fastening seal 300 may about 5.2:1 or may be in the range of about 4.94:1 to about 5.46:1 or may be in the range of about 4.16:1 to about 6.24:1.

The Upper retention portion 310 may be a cylindrical, pliable member including an outer wall 310A and an inner wall 310B and may be manufactured from any one, or combination of, plastics and/or composite materials. In some embodiments retention portion 310 may be an overmold. In one example, upper retention portion 310 may be manufactured from TPE SANTOPRENE8211-45 50D with a YK 12848B Texture. Alternatively, upper retention portion 310 may be manufactured from any type of SANTOPRENE with any texture in the YK 1200 series of textures. The upper retention portion 310 may have a durometer of about 70 Shore A or may be in the range of about 35 Shore A to about 85 Shore A. Outer wall 310A may extend upward and inward (e.g., centerward) from interface 313 at the position where the upper retention portion 310 intersects with bottom engagement portion 320. Relative to an outer and/or outermost face of outer wall 320A of bottom engagement portion 320 below fillet 324, a top and/or topmost face of upper retention portion 310 may have an angle (designated as angle "F" in FIG. 3D) of about 101.5°, or may be in the range of about 96.4° to about 106.6°, or may in the range of about 90.0° to about 121.8°, or may be in the range of 95° to 110°. The upper retention portion 310 may be configured to bend either upwardly or downwardly in response to an applied force.

Outer wall 310A and inner wall 310B of retention portion 310 may intersect at mouth ridge 312. Mouth ridge 312 (designated as dimension "G" in FIG. 3C) may have a diameter of about 2.16 in (e.g., about 55 mm) or may have a diameter in the range of about 2.05 in to about 2.27 in (e.g., about 52.3 mm to about 57.8 mm), or may have a diameter in the range of about 1.73 in to about 2.59 in (e.g., about 44.0 mm to about 66.0 mm), or may have a diameter of 52 mm to 57 mm. Mouth ridge 312 may be the interior most and/or innermost portion, body, face, and/or area of seal 300 and may demarcate the opening through which a beverage container may protrude when inserted into container 200 in the state in which seal 300 is fastened to container 200. The ratio of the diameter of the mouth ridge 312 to the height of the tapered portion 234 may be about 6.15:1 or may be in the range of about 5.8:1 to about 6.5:1, or may be in the range of about 4.9:1 to about 7.4:1. Additionally, the ratio of the diameter of the mouth ridge 312 to the minimum diameter of inner wall 210B of the insulative holder 200 may be about 1.17:1 or may be in the range of about 1.1:1 to about 1.2:1, or may be in the range of about 0.9:1 to about 1.4:1, or may be in the range of 1.4:1 to 1.5:1.

Inner wall 310B may extend outwardly (e.g., radially) from mouth ridge 312 to interface 313 wherein the upper retention portion 310 intersects with bottom engagement portion 320. Inner wall 310B may be manufactured from TPE SANTOPRENE 8211-45 50D with a YS 1290B Texture. Alternatively, inner wall 310B may be manufactured from any SANTOPRENE with any texture in the YS 1200 series of textures. The inner wall 310B may include a radial fillet 314 ranging from about 0.12 in to about 0.16 in (e.g., about 3.04 mm to about 4.06 mm) and, in one example, may be about 0.14 in (e.g., about 3.55 mm). Inner wall 310B may be configured to contact, engage, and/or otherwise frictionally interface with a beverage container inserted into container 200 in the state in which seal 300 is fastened to container 200. As described above, the upper retention portion 310 may be a flexible member configured to bend upwardly when fastening seal 300 is in contact with a beverage container inserted into beverage holder 200 as shown, for example, in FIG. 1B.

As shown in FIG. 3F, in some instances, inner wall 310B may include a plurality of upraised bumps 316. The plurality of upraised bumps 316 may reduce the surface area of the inner wall 310B in contact with a beverage container inserted into container 200 in the state in which seal 300 is fastened to container 200. The plurality of upraised bumps 316 may be randomly distributed on inner wall 310B, radially distributed, or the like. In instances in which the upraised bumps 316 are included on inner wall 310B, the friction force of the inner wall 310B may be decreased. Additionally and/or alternatively, inner wall 310B may be a texturized surface configured to reduce the surface area of the inner wall 310B in contact with a beverage container. The texture of inner wall 310B may be uniform or irregular and may serve to reduce the friction force of the inner wall 310B against a beverage container in a state in which the beverage container is inserted into container 200 and seal 300 is fastened to container 200.

At interface 313, upper retention portion 310 may transition to bottom engagement portion 320. Interface 313 may further include injection post 317 which may demarcate the point at which upper retention portion 310 overhangs into the mouth of seal 300. The injection post 317 may range in distance from 0.5 in to 1.8 in (e.g., 1.27 cm to 4.57 cm) or 0.7 in to 1.6 in (e.g., 1.78 cm to 4.06 cm) radially from the centermost and/or interior most axial plane of seal 300. In one example, injection post 317 may be about 1.37 in in radial distance (e.g., about 3.47 cm in radial distance) from the centermost and/or interior most axial plane of seal 300. Bottom engagement portion 320 may be a cylindrical member including an outer wall 320A and an inner wall 320B and may be manufactured from any one, or combination of metals, plastics, and/or composite materials. In some instances, bottom engagement portion 320 and upper retention portion 310 may be manufactured from the same material and in other instances bottom engagement portion 320 and upper retention portion 310 may be manufactured from different materials.

Outer wall 320A of bottom engagement portion 320 may include a fillet 324 between interface 313 and upper diameter 321 of about 2.25 mm. Outer wall 320A may be manufactured from PP Hifax TYC 852P w/20% TAC/mineral with a YK 12848B Texture. In another example, outer wall 320A may be manufactured from any Hifax with any YK 1200 series texture. Outer wall 320A may extend downward and outward from fillet 324 to lowermost and/or bottommost ridge 323 at an angle ranging from 0° to 10° or from 0.1° to 2°. In one example, outer wall 320A may extend downward and outward from fillet 324 to lowermost and/or bottommost ridge 323 at an angle of 1.5°. Accordingly, the diameter of outer wall 320B may linearly increase from a minimum diameter at upper diameter 321 to a maximum diameter at lower diameter 322. In one example, the upper diameter 321 may be about 3.06 in (e.g., about 77.81 mm) or in the range of about 2.9 in to about 3.21 in (e.g., about 73.9 mm to about 81.7 mm), or may be in the range of about 2.44 in to about 3.67 in (e.g., about 62.2 mm to about 93.4 mm). In one example, lower diameter 322 may be about 3.1 in (e.g., about 78.75 mm) or may be in the range of about 2.94 in to about 3.25 (e.g., about 74.8 mm to about 82.7 mm), or may be in the range of about 2.48 in to about 3.72 in (e.g., about 63 mm to about 94.5 mm).

Outer wall 320A may include a fillet 325 between lower diameter 322 and lowermost and/or bottommost ridge 323 of bottom engagement portion of about 0.049 in (e.g., about 1.25 mm). At the lowermost and/or bottommost ridge 323, outer wall 320A may transition to inner wall 320B. In one example, inner wall 320B may be manufactured from PP Hifax TYC 852P w/20% TAC/mineral with a Polish B-2 Texture. In another example, outer wall 320A may be manufactured from any Hifax with any polish texture. In some instances, inner wall 320B may have a homogeneous diameter (e.g., constant diameter) and in other instances, the diameter of inner wall 320B may linearly increase from a minimum diameter proximate to upper retention portion 310 to a maximum diameter proximate to lowermost and/or bottommost ridge 323.

Inner wall 320B may include a fastening ridge 326. Fastening ridge 326 may be a protrusion extending from the outer face of inner wall 320B and may spiral around the circumference of the outer wall 320B from an upper end proximate to upper retention portion 310 to a bottom end proximate to lowermost and/or bottommost ridge 323. The fastening ridge 326 may be configured interface with a fastening ridge 224 of insulative beverage holster 200. Through the engagement of fastening ridge 326 of seal 300 and fastening ridge 224 of insulative beverage holster 200, seal 300 may be configured to be detachably attached to beverage insulative holder 200. In some instances, the inner wall 320B and/or fastening ridge 326 may be made from and/or coated with polypropylene.

Prior to receiving a beverage container, the container 200 and the fastening seal 300 of the beverage holder 100 may be disengaged, unfastened, and/or detached. The beverage container may be inserted into the beverage holder 200 in the state in which container 200 and fastening seal 300 are disengaged, unfastened, and/or detached. After the beverage container has been inserted into the beverage holder 200, the fastening seal 300 may be placed over the beverage container and rotatably fastened to beverage holder 200. Once the fastening seal 300 has been detachably attached to beverage holder 200, the inserted beverage container may be secured in beverage holder 100. Conversely, when the beverage container is ready to be removed, the fastening seal 300 may be rotatably unfastened from beverage holder 200 and the fastening seal 300 may be removed from over the beverage container. At such a point, the beverage container may be extracted from the beverage holder 200. It is also contemplated that the flexibility of the seal can provide for the beverage container to be placed into and removed from the container 200 while the fastening seal 300 is attached to the container 200. Alternatively, seal 300 may be configured to engage with beverage holster 200 through a frictional fit, snap fit, barbed connection, bayonet connection, ball and socket interface, and the like.

As described in more detail above beverage holder 100 may have certain dimensions and relationships between sizes of particular portions that advantageously affect the use of the beverage holder 100. Example ranges for the dimensions described above for the beverage holder 100 in accordance with this disclosure are set forth in Table 1 below:

TABLE 1

Example Dimensional Ranges of Beverage Holder 100

| | Min. (mm) | Max. (mm) |
|---|---|---|
| Container 200 Height - "A" | 95.72 | 156.46 |
| Inner Wall 210B Maximum Diameter - "B" | 56.96 | 87.50 |
| Inner Wall 210B Minimum Diameter - "C" | 37.60 | 56.40 |
| Height of Tapered Portion 234 - "D" | 7.16 | 10.74 |
| Tapered Portion 234 Angle - "E" | 111.20 | 166.80 |
| Mouth Ridge 312 Diameter - "G" | 44.00 | 66.00 |
| Height of Fastening Seal 300 - "H" | 18.40 | 27.60 |
| Angle between Bottom Engagement Portion 320 and Upper Retention Portion 310 - "F" | 90.00 | 121.80 |
| Ratio of Inner Wall 210B Maximum Diameter ("B") to Inner Wall 210B Minimum Diameter ("C") - B/C:1 | 1.21 | 1.82 |
| Ratio of Mouth Ridge 312 Diameter ("G") to Height of Tapered Portion 234 ("D") - G/D:1 | 4.92 | 7.37 |
| Ratio of Container 200 Height ("A") to Height of Fastening Seal 300 ("H") - A/H:1 | 4.16 | 6.24 |
| Ratio of Mouth Ridge 312 Diameter ("G") to Inner Wall 210B Minimum Diameter ("C") - G/C:1 | 0.94 | 1.40 |

Table 1 above describes some general ranges of dimensions that may be used and characteristics that may be exhibited by some specific examples of the beverage holder 100 and in accordance with this disclosure. Table 2 below provides additional, more particular ranges of dimensions, at least some of which may be exhibited by at least some example beverage holder 100 in accordance with this disclosure:

TABLE 2

Example Dimensional Ranges of Beverage Holder 100

| | Min. (mm) | Max. (mm) |
|---|---|---|
| Container 200 Height - "A" | 113.67 | 125.63 |
| Inner Wall 210B Maximum Diameter - "B" | 63.4 | 74.76 |
| Inner Wall 210B Minimum Diameter - "C" | 44.65 | 49.35 |
| Height of Tapered Portion 234 - "D" | 8.50 | 9.40 |
| Tapered Portion 234 Angle - "E" | 132.05 | 145.95 |
| Mouth Ridge 312 Diameter - "G" | 52.25 | 57.75 |
| Height of Fastening Seal 300 - "H" | 21.85 | 24.15 |
| Angle between Bottom Engagement Portion 320 and Upper Retention Portion 310 - "F" | 96.43 | 106.58 |
| Ratio of Inner Wall 210B Maximum Diameter ("B") to Inner Wall 210B Minimum Diameter ("C") - B/C:1 | 1.44 | 1.59 |
| Ratio of Mouth Ridge 312 Diameter ("G") to Height of Tapered Portion 234 ("D") - G/D:1 | 5.84 | 6.45 |
| Ratio of Container 200 Height ("A") to Height of Fastening Seal 300 ("H") - A/H:1 | 4.94 | 5.46 |
| Ratio of Mouth Ridge 312 Diameter ("G") to Inner Wall 210B Minimum Diameter ("C") - G/C:1 | 1.11 | 1.23 |

The various ranges provided in Table 2 are simply examples. A beverage holder 100 need not have dimensions or characteristics that satisfy all of these identified ranges to fall within the scope of this disclosure. Table 3 provides even more targeted dimensions and characteristics of a beverage holder 100 in accordance with a specific example of this disclosure. Of course, a beverage holder 100 need not have these specific dimensions and/or characteristics to fall within the scope of this disclosure.

TABLE 3

Example Dimensional Ranges of Beverage Holder 100

| | (mm) |
|---|---|
| Container 200 Height - "A" | 119.65 |
| Inner Wall 210B Maximum Diameter - "B" | 67.6 |
| Inner Wall 210B Minimum Diameter - "C" | 47.00 |
| Height of Tapered Portion 234 - "D" | 8.95 |
| Tapered Portion 234 Angle - "E" | 139 |
| Mouth Ridge 312 Diameter - "G" | 55.00 |
| Height of Fastening Seal 300 - "H" | 23.00 |
| Angle between Bottom Engagement Portion 320 and Upper Retention Portion 310 - "F" | 101.50 |
| Ratio of Container 200 Height ("A") to Height of Tapered Portion 234 ("D") - A/D:1 | 13.37 |
| Ratio Inner Wall 210B Maximum Diameter ("B") to Inner Wall 210B Minimum Diameter ("C") - B/C:1 | 1.51 |
| Ratio of Mouth Ridge 312 Diameter ("G") to Height of Tapered Portion 234 ("D") - G/D:1 | 6.15 |
| Ratio of Container 200 Height ("A") to Height of Fastening Seal 300 ("H") - A/H:1 | 5.20 |
| Ratio of Mouth Ridge 312 Diameter ("G") to Inner Wall 210B Minimum Diameter ("C") - G/C:1 | 1.17 |

While specific dimensions, characteristics, and/or ranges of dimensions and characteristics are set forth in the various tables above, those skilled in the art will recognize that these dimensions and ranges are examples that may be used in at least some examples of this disclosure. Many variations in the ranges and the specific dimensions and characteristics may be used without departing from this disclosure.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers wherein the retention portion comprises an upper retention portion and a bottom engagement portion wherein the upper retention portion intersects the bottom engagement portion forming an angle from 95° to 110°, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers.

2. The beverage holder of claim 1, wherein the second inner wall further comprises a tapered portion extends between the bottom portion and the sidewall portion, the tapered portion having a maximum diameter at an intersection with the sidewall portion and a minimum diameter at an intersection with the bottom portion and wherein the tapered portion helps to accommodate multiple different sized containers.

3. The beverage holder of claim 1, wherein the container is formed of a first material, the engagement portion is formed of a second material, and the retention portion is formed of a third material, and wherein each of the first material, the second material, and the third material have different material characteristics.

4. The beverage holder of claim 3, wherein the third material is more flexible than the second material, and wherein the second material is more flexible than the first material.

5. The beverage holder of claim 1, wherein the retention portion is lined with one or more of rubber and plastic to increase frictional contact between the retention portion and the beverage container.

6. The beverage holder of claim 1, wherein the bottom portion of the second inner wall is substantially flat.

7. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers, and wherein the retention portion further comprises an outer wall and an inner wall wherein the intersection of the outer wall and the inner wall form a mouth ridge, and wherein the mouth ridge has a diameter of 52 mm to 57 mm.

8. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion wherein the second inner wall further comprises a tapered portion extends between the bottom portion and the sidewall portion, the tapered portion having a maximum diameter at an intersection with the sidewall portion and a minimum diameter at an intersection with the bottom portion and wherein the tapered portion helps to accommodate multiple different sized containers wherein the tapered portion has a height defined as the distance from an intersection point of the tapered portion and a bottom of the sidewall portion to an intersection point of the tapered portion and the bottom portion, and wherein the height is 8 mm to 9 mm; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers.

9. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion wherein the second inner wall further comprises a tapered portion extends between the bottom portion and the sidewall portion, the tapered portion having a maximum diameter at an intersection with the sidewall portion and a minimum diameter at an intersection with the bottom portion and wherein the tapered portion helps to accommodate multiple different sized containers wherein the tapered portion slopes inward and downward from an intersection point at a bottom of the sidewall portion to an intersection point of the bottom portion and wherein an angle formed between the tapered portion and the bottom portion of the second inner wall is 132° to 146°; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers.

10. The beverage holder of claim 1, wherein the container has a height of 113 mm to 125 mm.

11. The beverage holder of claim 1, wherein a distance between a bottommost portion of a beverage container inserted into the beverage holder and the bottom portion of the second inner wall of the beverage holder is linearly related to a diameter of the bottommost portion of the beverage container.

12. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion wherein the second inner wall further comprises a tapered portion extends between the bottom portion and the sidewall portion, the tapered portion having a maximum diameter at an intersection with the sidewall portion and a minimum diameter at an intersection with the bottom portion and wherein the tapered portion helps to accommodate multiple different sized containers wherein the tapered portion further includes a maximum diameter at the intersection point at the bottom of the sidewall portion and a minimum diameter at the intersection point of the bottom portion, and wherein a ratio of the maximum diameter of the tapered portion to the minimum diameter of the tapered portion is 1.4:1 to 1.5:1; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers.

13. A beverage holder for accommodating different sized beverage containers, the beverage holder comprising:

a container comprising:

a first outer wall forming an outer shell of the container, the first outer wall having a top portion and a bottom end configured to support the container on a surface;

a second inner wall having a top end and an opening extending into an internal reservoir for receiving different sized beverage containers, the second inner wall having a sidewall portion and a bottom portion wherein the second inner wall further comprises a tapered portion extends between the bottom portion and the sidewall portion, the tapered portion having a maximum diameter at an intersection with the sidewall portion and a minimum diameter at an intersection with the bottom portion and wherein the tapered portion helps to accommodate multiple different sized containers;

a mouth at an uppermost portion of the top portion and an end cap bottom of the bottom portion wherein a height of the container is defined by a distance from the mouth to the end cap bottom wherein a ratio of the height of the container to the height of the tapered portion is 12.7 to 14:1; and a sealed vacuum cavity forming an insulated double wall structure between the first outer wall and the second inner wall;

a fastening seal comprising:

an engagement portion, configured to removably engage the sidewall of the first outer wall of the container; and a retention portion configured to engage different sized beverage containers, wherein the retention portion together with the second inner wall are configured to accommodate different sized beverage containers such that the retention portion engages a first end of a beverage container and the second inner wall maintains contact with a second end of the beverage container such that both the first and the second end are held into place in the beverage holder to minimize oscillation of the first end and second end of the beverage container in the container for multiple different sized containers.

14. A beverage holder for holding a beverage container, the beverage holder comprising:

a container comprising:

a first outer wall forming an outer shell of the container and, the first outer wall having a top portion and a bottom end configured to support the container on a surface;

a second inner wall having a top end and an opening extending into an internal reservoir for receiving the beverage container, the second inner wall having a sidewall portion, a tapered portion, and a bottom portion, wherein the tapered portion slopes inward and downward from an intersection point at a bottom of the sidewall portion to an intersection point of the bottom portion, and wherein an angle formed between the tapered portion and the bottom portion of the second inner wall is 130° to 150°; and a sealed vacuum cavity forming an insulated double wall structure between the first outer wall and the second inner wall;

wherein the bottom portion of the second inner wall is substantially flat; and wherein a distance between a bottommost portion of the beverage container inserted into the beverage holder and the bottom portion of the second inner wall of the beverage holder is linearly related to a diameter of the bottommost portion of the beverage container.

15. The beverage holder of claim 14, wherein the tapered portion extends between the bottom portion and the sidewall portion, the tapered portion having a maximum diameter at an intersection with the sidewall portion and a minimum diameter at an intersection with the bottom portion.

16. A beverage holder for holding a beverage container, the beverage holder comprising:

a container comprising:

a first outer wall forming an outer shell of the container and, the first outer wall having a top portion and a bottom end configured to support the container on a surface;

a second inner wall having a top end and an opening extending into an internal reservoir for receiving the beverage container, the second inner wall having a sidewall portion, a tapered portion, and a bottom portion, wherein the tapered portion slopes inward and downward from an intersection point at a bottom of the sidewall portion to an intersection point of the bottom portion wherein the tapered portion further includes a maximum diameter at the intersection point at the bottom of the sidewall portion and a minimum diameter at the intersection point of the bottom portion, and wherein the ratio of the maximum diameter of the tapered portion to the minimum diameter of the tapered portion is 1.4:1 to 1.5:1; and a sealed vacuum cavity forming an insulated double wall structure between the first outer wall and the second inner wall;

wherein the bottom portion of the second inner wall is substantially flat; and wherein a distance between a bottommost portion of the beverage container inserted into the beverage holder and the bottom portion of the second inner wall of the beverage holder is linearly related to a diameter of the bottommost portion of the beverage container.

17. A beverage holder for holding a beverage container, the beverage holder comprising:

a container comprising:

a first outer wall forming an outer shell of the container and, the first outer wall having a top portion and a bottom end configured to support the container on a surface;

a second inner wall having a top end and an opening extending into an internal reservoir for receiving the beverage container, the second inner wall having a sidewall portion, a tapered portion, and a bottom portion, wherein the tapered portion slopes inward and downward from an intersection point at a bottom of the sidewall portion to an intersection point of the bottom portion;

a mouth at an uppermost portion of the top portion, an end cap bottom of the bottom portion wherein a height of the container defined by a distance from the mouth to the end cap bottom wherein a height of the tapered portion is defined as the distance from an intersection point of the tapered portion and a bottom of the sidewall portion to an intersection point of the tapered portion and the bottom portion and wherein a ratio of the height of the container to the height of the tapered portion is 12.7:1 to 14:1; and a sealed vacuum cavity forming an insulated double wall structure between the first outer wall and the second inner wall;

wherein the bottom portion of the second inner wall is substantially flat; and wherein a distance between a bottommost portion of the beverage container inserted into the beverage holder and the bottom portion of the second inner wall of the beverage holder is linearly related to a diameter of the bottommost portion of the beverage container.

18. The beverage holder of claim 14, further comprising:

a fastening seal comprising:

an engagement portion, configured to removably engage the container; and a retention portion configured to engage the beverage container, the retention portion extending inward from the engagement portion, and the retention portion having an inner wall and an outer wall intersecting at a mouth ridge.

19. A beverage holder for holding a beverage container, the beverage holder comprising:

a fastening seal comprising:

an engagement portion, configured to removably engage a container, the engagement portion having an inner wall, configured to engage the container and having an outer wall; and a retention portion configured to engage the beverage container, the retention portion extending inward from the engagement portion, and the retention portion having an inner wall and an outer wall intersecting at a mouth ridge;

wherein the retention portion has a durometer of 35 Shore A to 85 Shore A;

wherein an angle formed between the outer wall of the retention portion and an outer wall of the engagement portion is obtuse;

wherein the engagement portion is formed of a first material, and the retention portion is formed of a second material, and wherein each of the first material, the second material have different material characteristics;

wherein the second material is more flexible than the first material.

20. A beverage holder for holding a beverage container, the beverage holder comprising:

a fastening seal comprising:

an engagement portion, configured to removably engage a container, the engagement portion having an inner wall, configured to engage the container and having an outer wall;

a retention portion configured to engage the beverage container, the retention portion extending inward from the engagement portion, and the retention portion having an inner wall and an outer wall intersecting at a mouth ridge;

wherein an angle formed between the outer wall of the retention portion and an outer wall of the engagement portion is obtuse;

wherein the engagement portion is formed of a first material, and the retention portion is formed of a second material, and wherein each of the first material, the second material have different material characteristics;

wherein the second material is more flexible than the first material;

a first outer wall forming an outer shell of the container and, the first outer wall having a top portion and a bottom end configured to support the container on a surface;

a second inner wall having a top end and an opening extending into an internal reservoir for receiving the beverage container, the second inner wall having a sidewall portion, a bottom portion, and a tapered portion between the bottom portion and the sidewall portion, the tapered portion having a maximum diameter at an intersection with the sidewall portion and a minimum diameter at an intersection with the bottom portion; and a sealed vacuum cavity forming an insulated double wall structure between the first outer wall and the second inner wall;

wherein the bottom portion of the second inner wall is substantially flat;

wherein the tapered portion slopes inward and downward from an intersection point at a bottom of the sidewall portion to an intersection point of the bottom portion and wherein an angle formed between the tapered portion and the bottom portion of the second inner wall is 130° to 150°; and wherein a distance between a bottommost portion of the beverage container inserted into the beverage holder and the bottom portion of the second inner wall of the beverage holder is linearly related to a diameter of the bottommost portion of the beverage container.

21. The beverage holder of claim 20, further comprising a mouth at an uppermost portion of the top portion and an end cap bottom of the bottom portion wherein a height of the container is defined by a distance from the mouth to the end cap bottom, wherein a height of the tapered portion is defined as the distance from an intersection point of the tapered portion and a bottom of the sidewall portion to an intersection point of the tapered portion and the bottom portion, and wherein a ratio of a height of the container to a height of the tapered portion is 12.7:1 to 14:1.

22. The beverage holder of claim 21, wherein the tapered portion further includes a maximum diameter at the intersection point at the bottom of the sidewall portion and a minimum diameter at the intersection point of the bottom portion, and wherein a ratio of the maximum diameter of the tapered portion of the second inner wall to the minimum diameter of the tapered portion of the second inner wall is 1.4:1 to 1.5:1.

* * * * *